US009428847B2

(12) United States Patent
Scott et al.

(10) Patent No.: US 9,428,847 B2
(45) Date of Patent: Aug. 30, 2016

(54) APPARATUS, METHODS, AND FLUID COMPOSITIONS FOR ELECTROSTATICALLY-DRIVEN SOLVENT EJECTION OR PARTICLE FORMATION

(75) Inventors: Ashley S. Scott, Grove City, OH (US); Andrew L. Washington, Jr., Pataskala, OH (US); John A. Robertson, Chillicothe, OH (US)

(73) Assignee: NANOSTATICS CORPORATION, Milwaukee, WI (US)

( * ) Notice: Subject to any disclaimer, the term of this patent is extended or adjusted under 35 U.S.C. 154(b) by 1151 days.

(21) Appl. No.: 13/118,409

(22) Filed: May 28, 2011

(65) Prior Publication Data

US 2012/0004370 A1 Jan. 5, 2012

Related U.S. Application Data

(60) Provisional application No. 61/349,832, filed on May 29, 2010.

(51) Int. Cl.

| | |
|---|---|
| ***B05B 5/00*** | (2006.01) |
| ***D01D 5/00*** | (2006.01) |
| ***B05B 5/025*** | (2006.01) |
| *B05B 1/14* | (2006.01) |

(52) U.S. Cl.

CPC ..... *D01D 5/003* (2013.01); *B05B 5/0255* (2013.01); *D01D 5/0061* (2013.01); *B05B 1/14* (2013.01)

(58) Field of Classification Search

CPC ... B05B 5/0255; D01D 5/003; D01D 5/0061
USPC ..... 264/10
See application file for complete search history.

(56) References Cited

U.S. PATENT DOCUMENTS

| | | | |
|---|---|---|---|
| 1,975,504 | A | 10/1934 | Formhals |
| 2,160,962 | A | 6/1939 | Formhals |
| 2,187,306 | A | 1/1940 | Formhals |

(Continued)

FOREIGN PATENT DOCUMENTS

| | | |
|---|---|---|
| CN | 101003917 | 7/2007 |
| JP | 4351094 | 9/2005 |

(Continued)

OTHER PUBLICATIONS

Jaworek, A; Sobzyk, AT; "Electrospraying route to nanotechnology: An overview", Journal of Electrostatics, 2008, vol. 66, p. 197-219.*

(Continued)

*Primary Examiner* — Alison L Hindenlang
(74) *Attorney, Agent, or Firm* — David S. Alavi

(57) ABSTRACT

A method comprises introducing a fluid composition into one or more electrically insulating emitters, and applying voltage to the fluid to cause ejection of the solvent from the fluid after it exits the emitter. The fluid composition comprises first material having a dielectric constant greater than ~25 and polymer mixed into liquid solvent having a dielectric constant less than ~15, or polymer mixed into solvent having a dielectric constant greater than ~8. Voltage can be applied to the fluid composition via a conductive electrode immersed in the fluid, or positioned outside and adjacent to the emitters. Conductivity of the fluid composition can be less than ~100 μS/cm. A composition of matter comprises nanofibers formed by the method.

79 Claims, 11 Drawing Sheets

(56) References Cited

U.S. PATENT DOCUMENTS

| | | | | |
|---|---|---|---|---|
| 2,323,025 | A | 6/1943 | Formhals | |
| 2,349,950 | A | 5/1944 | Formhals | |
| 4,284,594 | A | 8/1981 | Joh et al. | |
| 4,757,421 | A * | 7/1988 | Mykkanen | 361/231 |
| 6,793,856 | B2 * | 9/2004 | Hartmann et al. | 264/141 |
| 7,591,883 | B2 | 9/2009 | Kameoka et al. | |
| 2005/0025974 | A1 | 2/2005 | Lennhoff | |
| 2005/0073075 | A1 | 4/2005 | Chu et al. | |
| 2005/0104258 | A1 | 5/2005 | Lennhoff | |
| 2005/0224998 | A1 | 10/2005 | Andrady et al. | |
| 2006/0057377 | A1 | 3/2006 | Harrison et al. | |
| 2007/0116640 | A1 | 5/2007 | Kim et al. | |
| 2007/0199824 | A1 * | 8/2007 | Hoerr et al. | 205/80 |
| 2007/0244569 | A1 | 10/2007 | Weber et al. | |
| 2008/0113214 | A1 | 5/2008 | Davis et al. | |
| 2008/0131615 | A1 | 6/2008 | Robertson et al. | |
| 2010/0239861 | A1 | 9/2010 | Scott et al. | |
| 2013/0280436 | A1 | 10/2013 | Scott et al. | |

FOREIGN PATENT DOCUMENTS

| | | |
|---|---|---|
| JP | 2008-69478 | 3/2008 |
| KR | 10-2005-0062683 | 6/2005 |
| WO | WO 2004/016839 | 2/2004 |
| WO | WO 2005/026398 | 3/2005 |
| WO | WO 2005/090653 | 9/2005 |
| WO | WO 2008/063866 | 5/2008 |
| WO | WO 2008/063870 | 5/2008 |
| WO | WO 2008/073662 | 6/2008 |
| WO | WO 2009/030355 | 3/2009 |
| WO | WO 2010/028339 | 3/2010 |

OTHER PUBLICATIONS

"Cross-link", wikipedia.org, accessed at http://en.wikipedia.org/wiki/Cross-link on Jan. 8, 2015.*

"Electrospray Ionization", wikipedia.org, Apr. 29, 2009 revision, accessed at http://en.wikipedia.org/w/index.php?title=Electrospray_ionization&oldid=286789559 on Jan. 8, 2015.*

"Chemical Constants of d-Linomene", Florida Chemical Company accessed at http://www.floridachemical.com/dlimonenechemical_constants.htm on Dec. 19, 2014.*

"Dielectric Constants of Common Materials", kabusa.com, accessed at http://www.kabusa.com/Dilectric-Constants.pdf on Dec. 19, 2014.*

"Dielectric Charts", washington.edu, accessed at http://depts.washington.edu/eooptic/linkfiles/dielectric_chart[1].pdf on Dec. 19, 2014.*

International Search Report and Written Opinion dated Feb. 9, 2012 for counterpart App No. PCT/US2011/038470.

Zhang et al; IEEE Power Modulator and High Voltage Conference; p. 221 (May 27, 2010).

Lin et al; Nanotechnology; vol. 15 p. 1375 (Aug. 13, 2004).

Yuh et al; Materials Letters; vol. 59 p. 3645 (Jul. 21, 2005).

International Search Report and Written Opinion dated Nov. 4, 2010 for co-owned App No. PCT/US2010/028019.

Deery et al; Rapid Comm Mass Spec; v 11, p. 57 (1997).

Li et al; Advanced Materials; v 16, n 14, p. 1151 (2004).

Subbiah et al; J Appl Polymer Sci; v 96, p. 557 (2005).

Huang et al; Composite Sci & Tech; v 63, p. 2223 (2003).

Pattamaprom et al; Macromol Materials & Eng; v 291, p. 840 (2006).

Toshima et al; J Macromol Sci A; v 25, p. 1349 (1988).

Sharma et al; Polymer Int'l; v 25, p. 167 (1991).

Korkut et al; Phys Rev Lett; v 100, p. 034503 (2008).

Tripatanasuwan et al; Polymer; v 50, p. 1835 (2009).

Keki et al; Rapid Comm Mass Spec; v 15, p. 675 (2001).

Hattori et al; Adv Polymer Tech; v 27, p. 35 (2008).

Hattori et al; J Wood Sci; (2009).

Eda et al; Eur Polymer J; v 43, p. 1154 (2007).

Hayati; Collis & Surfaces; v 65, p. 77 (1992).

Hayati et al; J Colloid Interface Sci; v 117, p. 205 (1987).

Hayati et al; J Colloid Interface Sci; v 117, p. 222 (1987).

Hohman et al; Physics of Fluids; v 13, p. 2201 (2001).

Hohman et al; Physics of Fluids; v 13, p. 2221 (2001).

Han et al; Polymer Degradation & Stability; v 86, p. 257 (2004).

Shin et al; Polymer; v 42, p. 9955 (2001).

Moon et al; J Appl Polymer Sci; v 109 p. 691 (2008).

Morget et al; NASA Report TM-2005-213786 (2005).

Taylor; Proc R Soc London A; v 280, p. 383 (1964).

* cited by examiner

APPARATUS, METHODS, AND FLUID COMPOSITIONS FOR ELECTROSTATICALLY-DRIVEN SOLVENT EJECTION OR PARTICLE FORMATION

BENEFIT CLAIMS TO RELATED APPLICATIONS

This application claims benefit of U.S. provisional App. No. 61/349,832 entitled "Apparatus, methods, and fluid compositions for electrostatically-driven solvent ejection or particle formation" filed May 29, 2010 in the names of Ashley S. Scott, Evan E. Koslow, Andrew L. Washington, Jr., John A. Robertson, Adria F. Lotus, Jocelyn J. Tindale, Tatiana Lazareva, and Michael J. Bishop, said provisional application being hereby incorporated by reference as if fully set forth herein.

BACKGROUND

The field of the present invention relates to electrostatically-driven solvent ejection or particle formation. In particular, apparatus, methods, and reduced-conductivity fluid compositions are disclosed herein for electrostatically-driven (ESD) solvent ejection (e.g., spraying or atomization) or particle formation (e.g., formation of particles or fibers, including nanoparticles or nanofibers).

Nanostatics Corporation and GABAE Industries Corporation are parties to a joint research agreement that was in effect before the date the invention claimed herein was made. The invention claimed herein was made on behalf of Nanostatics Corporation as a result of activities undertaken within the scope of the joint research agreement.

The subject matter disclosed herein may be related to subject matter disclosed in co-owned: (i) U.S. non-provisional App. No. 11/634,012 entitled "Electrospraying/electrospinning array utilizing a replacement array of individual tip flow restriction" filed Dec. 5, 2006 (now Pat. No. 7,629,030); (ii) U.S. provisional App. No. 61/161,498 entitled "Electrospinning Cationic Polymers and Method" filed Mar. 19, 2009; (iii) U.S. provisional App. No. 61/256,873 entitled "Electrospinning with reduced current or using fluid of reduced conductivity" filed Oct. 30, 2009; and (iv) U.S. non-provisional App. No. 12/728,070 entitled "Fluid formulations for electric-field-driven spinning of fibers" filed Mar. 19, 2010 (now Pat. No. 8,518,319). Each of said provisional and non-provisional applications is hereby incorporated by reference as if fully set forth herein. Each of said applications was made on behalf of, and is owned by, Nanostatics Corporation.

"Electrospinning" and "electrospraying" conventionally refer to the production of, respectively, fibers or droplets, which may be "spun" as fibers or "sprayed" as droplets by applying high electrostatic fields to one or more fluid-filled spraying or spinning tips (i.e., emitters or spinnerets). Under suitable conditions and with suitable fluids, so-called nanofibers or nanodroplets can be formed from a Taylor cone that forms at each tip (although the terms are also applied to production of larger droplets or fibers). The high electrostatic field typically (at least when using a conventional, relatively conductive fluid) produces the Taylor cone at each tip opening from which fibers or droplets are emitted, the cone having a characteristic full angle of about 98.6°. The sprayed droplets or spun fibers are typically collected on a target substrate typically positioned several tens of centimeters away; solvent evaporation from the droplets or fibers during transit to the target typically plays a significant role in the formation of the droplets or fibers by conventional electrospinning and electrospraying. A high voltage supply provides an electrostatic potential difference (and hence the electrostatic field) between the spinning tip (usually at high voltage, either positive or negative) and the target substrate (usually grounded). A number of reviews of electrospinning have been published, including (i) Huang et al, "A review on polymer nanofibers by electrospinning and their applications in nanocomposites," *Composites Science and Technology*, Vol. 63, pp. 2223-2253 (2003), (ii) Li et al, "Electrospinning of nanofibers: reinventing the wheel?", *Advanced Materials*, Vol. 16, pp. 1151-1170 (2004), (iii) Subbiath et al, "Electrospinning of nanofibers," *Journal of Applied Polymer Science*, Vol. 96, pp. 557-569 (2005), and (iv) Bailey, *Electrostatic Spraying of Liquids* (John Wiley & Sons, New York, 1988). Details of conventional electrospinning materials and methods can be found in the preceding references and various other works cited therein, and need not be repeated here.

Conventional fluids for electrospinning (melts, solutions, colloids, suspensions, or mixtures, including many listed in the preceding references) typically possess significant fluid conductivity (e.g., ionic conductivity in a polar solvent, or a conducting polymer). Fluids conventionally deemed suitable for electrospinning have conductivity typically between 100 μS/cm and about 1 S/cm (Filatov et al; *Electrospinning of Micro-and Nanofibers*; Begell House, Inc; New York; 2007; p 6). It has been observed that electrospinning of nanometer-scale fibers using conventional fluids typically requires conductivity of about 1 mS/cm or more; lower conductivity typically yields micron-scale fibers. In addition, conventional methods of electrospinning typically include a syringe pump or other driver/controller of the flow of fluid to the spinning tip or emitter, and a conduction path between one pole of the high voltage supply (typically the high voltage pole) and the fluid to be spun. Such arrangements are shown, for example, in U.S. Pat. Pub. No. 2005/0224998 (hereafter, the '998 publication), which is incorporated by reference as if fully set forth herein. In FIG. 1 of the '998 publication is shown an electrospinning arrangement in which high voltage is applied directly to a conductive emitter (e.g., a spinning tip or nozzle), thereby establishing a conduction path between the high voltage supply and the fluid being spun. In FIGS. 2, 5, 6A, and 6B of the '998 publication are shown various electrospinning arrangements in which an electrode is placed within a chamber containing the fluid to be spun, thereby establishing a conduction path between one pole of the high voltage supply and the fluid. The chamber communicates with a plurality of spinning tips. In any of those arrangements, significant current (typically greater than 0.3 μA per spinning tip, often greater than 1 μA/tip) flows along with the spun polymer material. Conventional electrospinning fluids are deposited on metal target substrates so that current carried by the deposited material can flow out of the substrate (either to a common ground or back to the other pole of the high voltage supply), thereby "completing the circuit" and avoiding charge buildup on the target substrate. Even so, flow rates for electrospinning of conventional fluids are typically limited to a few μL/min/nozzle, particularly if nanofibers are desired (increasing the flow rate tends to increase the average diameter of fibers spun from conventional electrospinning fluids). Electrospinning onto nonconductive or insulating substrates has proven problematic due to charge buildup on the insulating substrate that eventually suppresses the electrospinning process. Application of electric fields greater than a few kV/cm to conventional fluids or to metal spinning tips often leads to arcing between the tip and the target substrate, typically precluding useful electrospinning.

Figure 1:
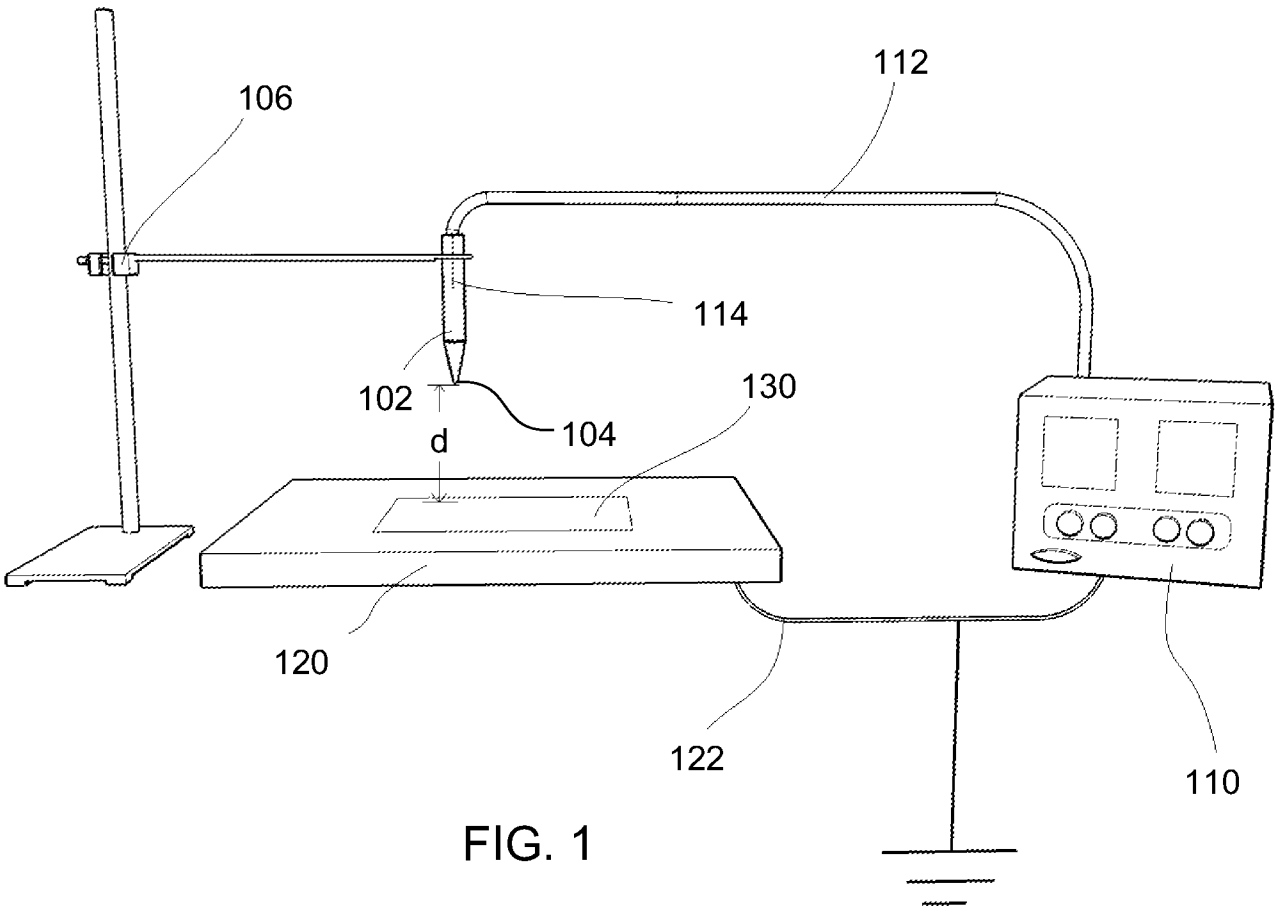
FIG. 1 illustrates schematically an exemplary apparatus for electrostatically-driven (ESD) solvent ejection or particle formation.

The embodiments shown in the Figures are exemplary, and should not be construed as limiting the scope of the present disclosure or appended claims.

DETAILED DESCRIPTION OF EMBODIMENTS

Conventional electrospinning of polymer-containing fibers or nanofibers, or electrospraying of small droplets, can be employed to produce a variety of useful materials. However, scaling up (beyond the laboratory or prototype level) an electrospinning process that employs conventional, relatively conductive fluid compositions has proven to be problematic. To achieve production-type quantities, multiple electrospinning tips are often employed, usually in an arrayed arrangement. However, the conductive fluids used and the significant current (often greater than 1 μA per tip) carried by fibers emerging from each tip lead to impractically large overall current and to undesirable electrostatic interactions among the electrospinning tips and fibers; these limit the number and density of electrospinning tips that can be successfully employed. Similar difficulties are typically encountered when electrospinning from a porous membrane emitter. Electrospinning onto non-conductive target surfaces is also problematic, as noted above.

Apparatus, methods, and fluid compositions are disclosed herein for electrostatically-driven (ESD) solvent ejection (e.g., spraying or atomization) or particle formation (e.g., formation of particles or fibers, including nanoparticles or nanofibers) by physical mechanism(s) distinct from conventional, evaporative electrospraying or electrospinning of conductive fluids from a single Taylor cone formed at an emitter orifice. The methods disclosed or claimed herein can be readily scaled up to production-scale quantities of material produced. The fluid compositions are emitted from electrically-insulating emitters (e.g., nozzles, capillaries, or tips) toward a target surface that is nonconductive or electrically isolated, and which need not be connected to a ground or voltage supply or positioned near any electrical ground (although the presence of an electrical ground plane behind or beneath an insulating target can help to direct particles toward the target once they form). Voltage can be, but need not be, applied directly to the fluid. Some of the fluid compositions disclosed herein exhibit substantially reduced conductivity (less than about 1 mS/cm, preferably less than about 100 μS/cm; some compositions less than about 50 μS/cm, less than about 30 μS/cm, or less than about 20 μS/cm) relative to conventional electrospinning fluid compositions (greater than about 100 μS/cm; typically greater than about 1 mS/cm for producing polymer nanofibers).

Some of the disclosed compositions comprise a first material having a dielectric constant greater than about 25 mixed into a liquid solvent having a dielectric constant less than about 15; in some disclosed examples the dielectric constant of the liquid solvent is less than about 10, or less than about 5. Some of the disclosed compositions include a salt, a surfactant (ionic or nonionic), or a dissolved ionic liquid. The nonconductive emitters, nonconductive or isolated target surface, and/or the reduced conductivity of some of the fluid compositions disclosed herein can at least partly mitigate the undesirable electrostatic interactions described above, can enable flow rates greater than about 100 μL/min/emitter, can enable use of multiple emitters spaced within, e.g., one centimeter or less of one another, can enable deposition of particles or fibers onto an electrically insulating or electrically isolated collection surface, or can enable formation and deposition of particles in the absence of a counter-electrode near the collection surface that is grounded or connected to the voltage supply driving the deposition.

Those reduced conductivity fluid compositions, and use of electrically insulating emitters and collection surface, can also enable use of higher voltages and/or smaller emitter-to-target distances (e.g., from just a few centimeters down to about 5 millimeters), which typically would result in arcing in a conventional electrospinning arrangement using conventional fluids. Emitter-to-target distances of about 5-20 cm are typically required in conventional electrospinning arrangements: close enough to enable application of sufficiently large electric fields without applying voltage high enough to cause arcing, but far enough to enable adequate evaporation of solvent from the spun fibers before they reach the target. Seemingly paradoxically, the compositions disclosed herein can also be employed in an arrangement wherein the target or collection surface is more than about 30 cm, or even 40 or 50 cm or more, from the emitter. Emission of the fluid composition into such an large, unimpeded volume appears to enhance the flow rate of the fluid and production rate of spun fibers (described further below).

Under conditions disclosed herein, and using fluid formulations disclosed herein, conventional Taylor cone formation, and conventional electrospinning or electrospraying from that Taylor cone, appear to be suppressed in favor of a different, non-evaporative mechanism for solvent ejection and particle formation from the fluid composition after it exits the emitter (fibers and nanofibers being considered elongated particles). Therefore, the term "electrostatically-driven (ESD) solvent ejection and particle formation," or simply "ESD solvent ejection," shall be employed to describe the observed phenomena disclosed herein and shall be considered distinct from conventional electrospinning or electrospraying.

Exemplary apparatus are illustrated schematically in the drawings, each comprising a nozzle 102 (the emitter) with an orifice 104 at its distal end, into which is introduced a fluid composition (described further below). Although nozzles 102 are shown and described in the exemplary embodiments, any suitable emitter can be equivalently employed. The nozzle 102 is supported by an insulating stand 106 or other suitable structure that electrically isolates the nozzle from its surroundings, and the nozzle 102 itself comprises one or more electrically insulating materials such as glass, plastic, polytetrafluoroethylene (PTFE), nylon, or other suitable insulating material that is also chemically compatible with the fluid composition. The nozzle 102 can act as a reservoir for the fluid composition (e.g., as in FIG. 1), or can communicate with a fluid reservoir. Multiple nozzles 102 can be employed, and can each communicate with a common fluid reservoir 108, if desired (as in FIGS. 2A/2B, for example). Flow of the fluid through the nozzle 102 can be driven by gravity by arranging for a suitable fluid head above the nozzle orifice 104, or can be driven by a pump (e.g., a syringe pump) or other flow-regulating device. The orifice 104 can be arranged to provide a suitable level of hydrodynamic resistance to flow of the fluid. In one suitable arrangement, a capillary tube (comprising, e.g., PTFE) can be inserted into the distal end of the nozzle 102 so that the distal end of the capillary tube acts as the orifice 104 and the proximal end of the capillary tube communicates with the interior of the nozzle 102 or with a fluid reservoir. In another suitable arrangement, a capillary tube acts as the entire emitter with its distal end acting as the orifice 104 (as in FIGS. 2A/2B, for example) and with its proximal end in communication with a fluid reservoir 108. An example of a suitable capillary tube has an inner diameter of about 0.5 mm and a length of about 2 to 20 cm or more; other suitable lengths or diameters can be employed to yield desired fluid flow characteristics. Suitable length and diameter of a capillary tube can be at least partly determined by the viscosity of the fluid composition, for example, with a longer or narrower capillary typically being employed for a less viscous fluid composition. Although nozzles 102 are shown and described in the exemplary embodiments, any suitable emitter can be equivalently employed, including but not limited to fritted glass, porous ceramic, a porous polymer membrane, one or more micromachined channels in an insulating plate, or interstitial channels among a bundle of fibers, filaments, or rods. If a porous or fritted material is employed as an emitter, the corresponding orifices are formed by individual pores of the material where they reach an edge or surface of the material.

A wide range of fluid compositions can be employed. A first group of suitable fluid compositions include compositions comprising a first material having a dielectric constant greater than about 25 mixed into a liquid solvent having a dielectric constant less than about 15. Many examples of suitable fluid compositions are described below that exhibit at least that degree of dielectric contrast. Most of the disclosed examples of high dielectric contrast fluid compositions also include a polymer dissolved, emulsified, or otherwise dispersed in the liquid solvent. In some exemplary fluid compositions of the first group, the first material has a dielectric constant greater than about 30, or the liquid solvent has a dielectric constant less than about 10 or less than about 5; other exemplary fluid compositions having still greater dielectric contrast are disclosed and can be employed. One or more additional materials can be included in the composition, each having a dielectric constant between those of the low-dielectric liquid solvent and the high-dielectric material, forming a so-called "dielectric ladder." A second group of exemplary fluid compositions comprise a salt, a surfactant (ionic or nonionic), or an ionic liquid dissolved or mixed into a liquid solvent, along with a dissolved, emulsified, or dispersed polymer. There can be some overlap between those first two groups of suitable fluid compositions, e.g., a salt, surfactant, or ionic liquid can act as a high dielectric material in a high contrast fluid composition, often as the "top rung" in a dielectric ladder. A third group of examples of suitable fluid compositions can comprise a polymer dissolved, emulsified, or dispersed in a liquid solvent, wherein the liquid solvent has a dielectric constant greater than about 8 and the primary dielectric contrast is between the solvent and the polymer, which has a dielectric constant less than about 4. In the third group of exemplary fluid compositions, there appears to be a positive correlation between solvent dielectric constant and maximum viscosity that permits ESD solvent ejection. Specific examples from all three groups of fluid composition types are described below. Exemplary compositions in all three groups exhibit conductivity less than about 1 mS/cm, preferably less than about 100 μS/cm. Conductivity less than about 50 μS/cm, less than about 30 μS/cm, or less than about 20 μS/cm can be advantageously employed.

Figure 2A:
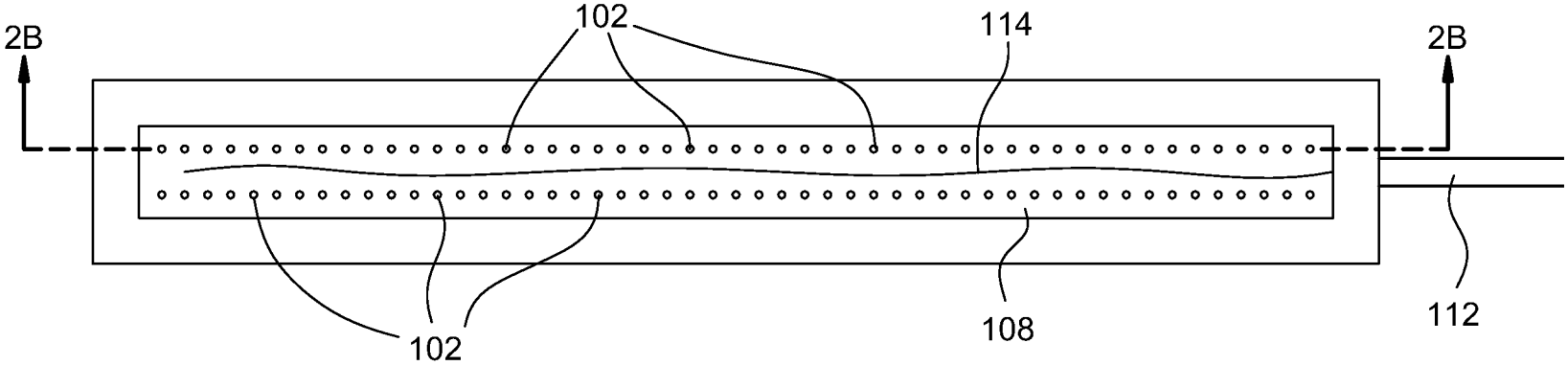
FIGS. 2A and 2B illustrate schematically an exemplary multi-nozzle head for ESD solvent ejection or particle formation.
Figure 2B:
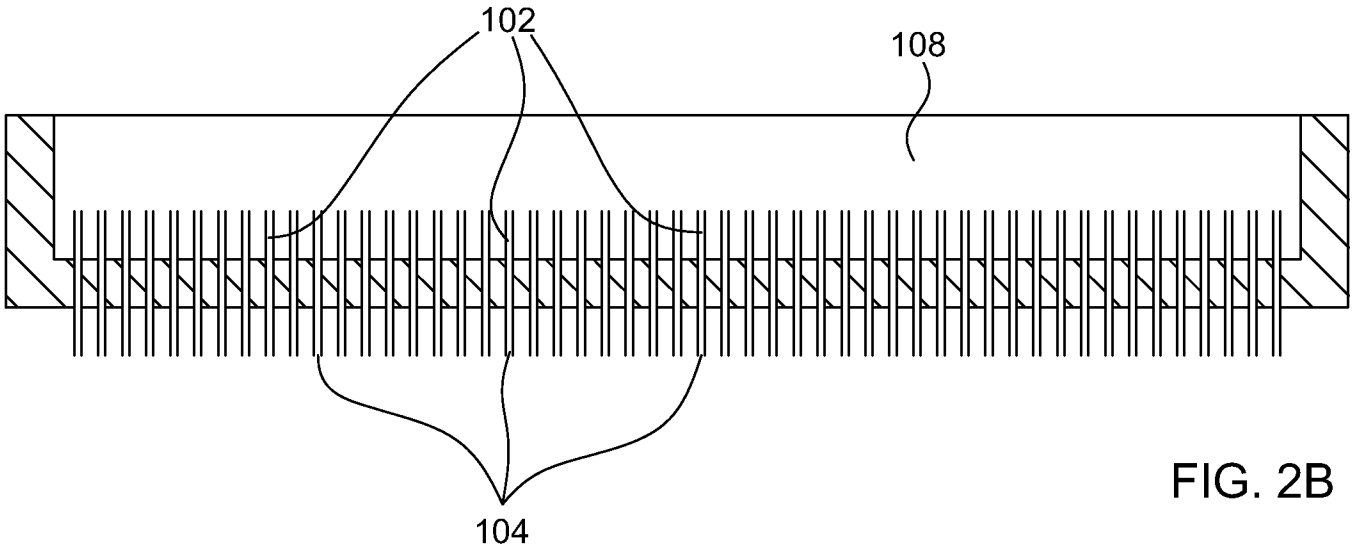

A power supply 110 applies a voltage to the fluid composition, in the examples of FIGS. 1, 2A/2B, 5A, 5B, and 6 through an insulated or shielded cable 112 and an electrode 114 that is immersed in the fluid composition (within the emitter 102 or within a fluid reservoir 108). When a suitable fluid composition is employed (e.g., having sufficiently large dielectric contrast and/or sufficiently low conductivity), applying sufficient voltage causes non-evaporative ejection of the solvent from the fluid composition after the fluid exits the emitter 102 through the orifice 104 (i.e., ESD solvent ejection). High-speed photography reveals that, upon application of sufficient voltage via immersed electrode 114, the fluid composition that exits the emitter 102 through orifice 104 forms one or more discrete fluid jets 342. Each of those jets rapidly becomes unstable and breaks up within about 2 to 3 mm from its corresponding point of formation (illustrated schematically in FIG. 3). Those jets 342 emerge from a portion of the meniscus 344 of the fluid that does not appear to form a typical Taylor cone (at least not one that is visibly protruding from the nozzle orifice 104), in contrast with a fluid jet emerging from a conventional, conductive electrospinning fluid (illustrated schematically in FIG. 4, with jet 442 emerging from a Taylor cone 444 formed at and visibly protruding from the orifice 404 of an emitter 402). While it may be possible for both types of fluid jets (ESD ejection and conventional Taylor cone electrospinning) to emerge from the fluid composition when voltage is applied, use of a fluid composition of one of the types disclosed herein, in an apparatus arranged and operated as disclosed herein, appears to favor production of fluid jets 342 that behave substantially as shown in FIG. 3, and to suppress production of a fluid jet 442 that emerges from a corresponding Taylor cone and behaves substantially as shown in FIG. 4.

Figure 3:
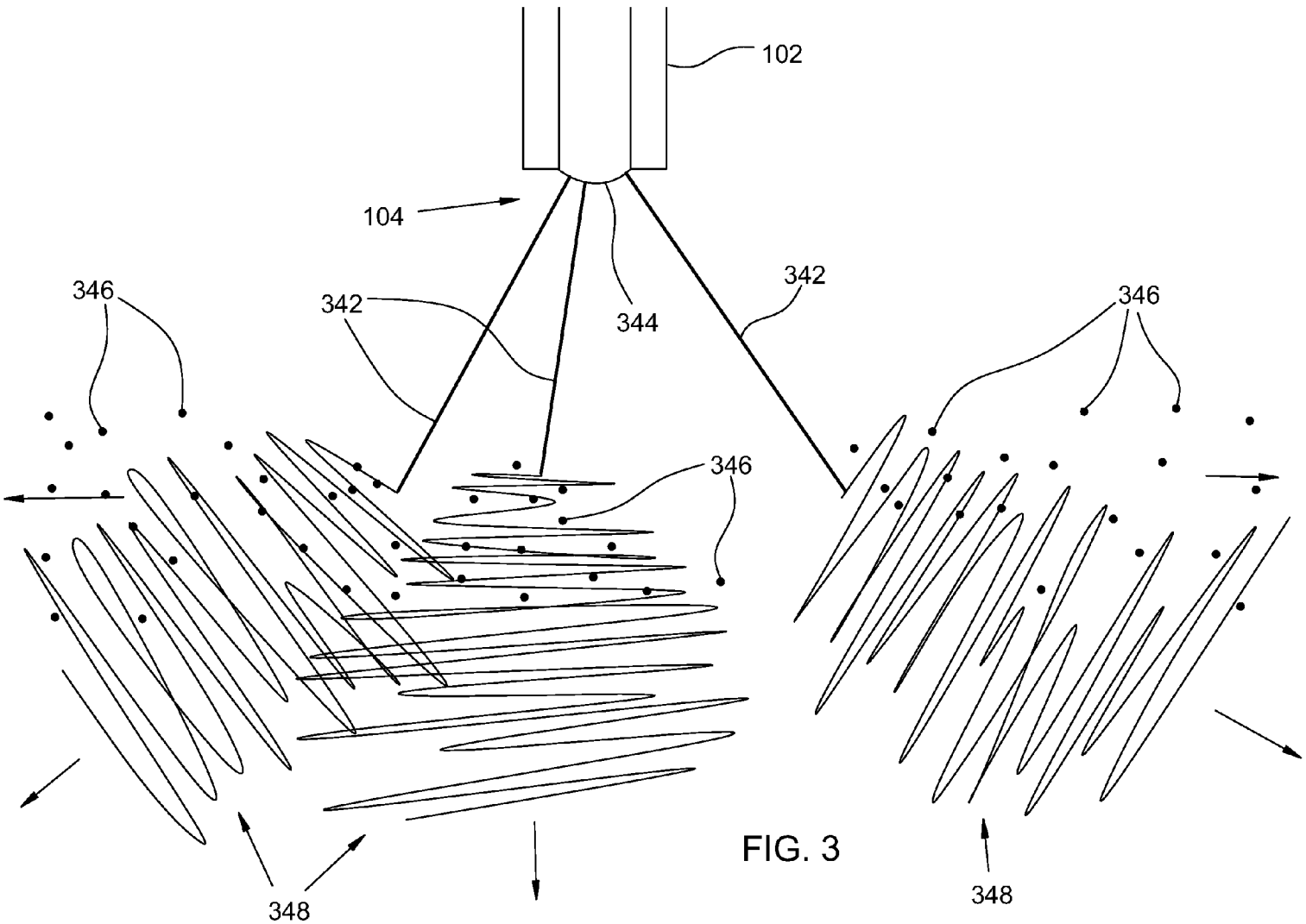
FIG. 3 illustrates schematically multiple fluid jets ejected during ESD solvent ejection and particle formation.
Figure 4:
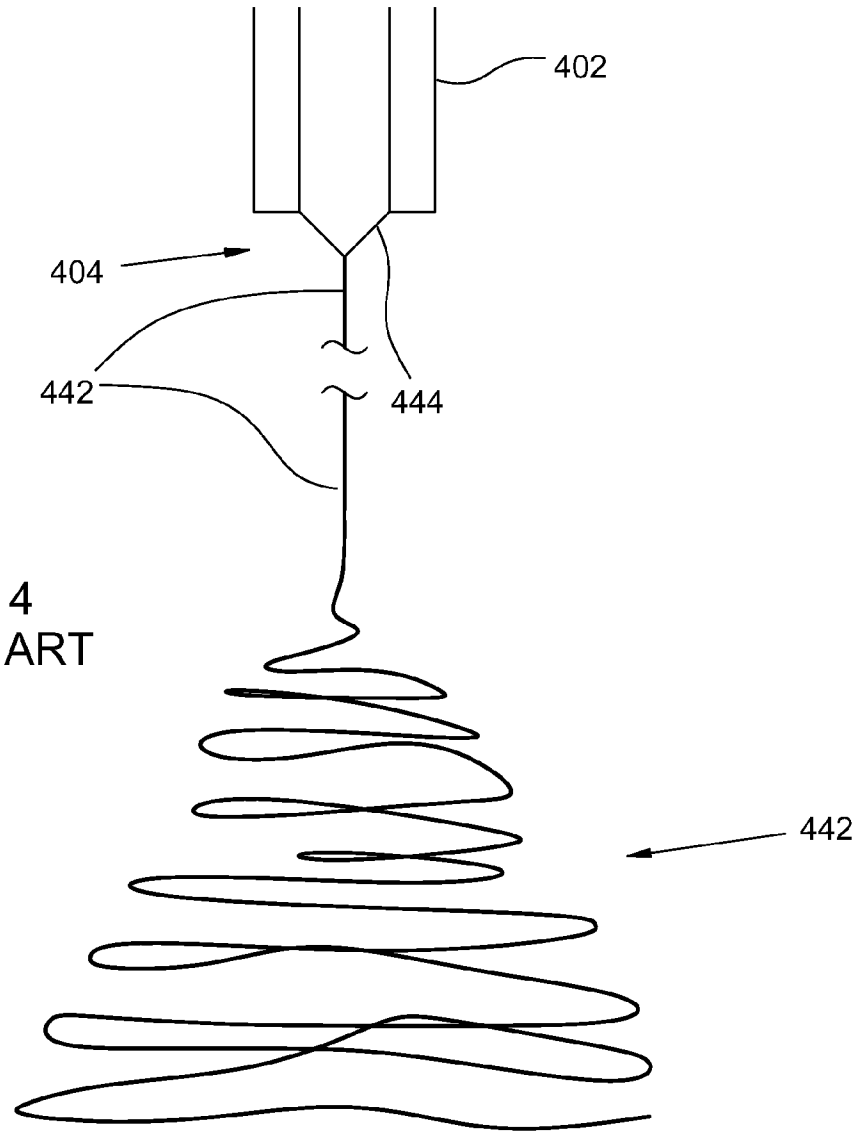
FIG. 4 PRIOR ART
FIG. 4 illustrates schematically a single fluid jet ejected during conventional Taylor cone electrospinning.

As illustrated schematically in FIG. 3, in ESD solvent ejection each of the fluid jets 342 typically (but not always) emerges at an angle with respect to the emitter 102. The jets 342 can vary, somewhat stochastically, in number and direction, sometimes forming an arrangement that resembles the ribs of an open umbrella. High-speed photography reveals that each fluid jet 342 abruptly breaks up and ejects solvent within about 2 to 3 mm of its corresponding point of formation. The solvent appears to be ejected in a direction substantially transverse to the emitter, and the ejection appears to be non-evaporative. The ejected solvent can subsequently evaporate, but appears to be ejected from the jet 342 initially as droplets 346.

The jet behavior depicted schematically in FIG. 3 has been observed previously (Eda et al; "Solvent effects on jet evolution during electrospinning of semi-dilute polystyrene solutions"; European Polymer Journal, Vol 43 p 1154 (2007)). However, previous workers failed to recognize the potential utility of that observed jet behavior. Applied electric fields were limited in previous work to less than about 4-5 kV/cm (most employed conducting emitters). By employing insulating emitters, an insulating or insulated collection surface, and relatively low-conductivity fluid compositions, larger electric fields can be employed that appears to enhance the jet behavior depicted in FIG. 3 and to suppress the jet behavior depicted in FIG. 4. This preferential behavior is advantageous because of the substantially larger fluid flow rates that can be achieved, e.g., greater than about 100 μL/min/emitter for the jets of FIG. 3. Rates as high as 2 mL/min/emitter have been observed with fluid compositions that include polymer, and up to 10 mL/min/emitter has been observed with fluid compositions that do not include polymer.

If the fluid composition includes a polymer, ESD ejection of the solvent causes formation of polymer particles or fibers 348 and separation of those particles or fibers 348 from the ejected solvent. Fibers can be considered as elongated particles, and the terms "particle" and "fiber" may be used somewhat interchangeably in the subsequent discussion to encompass both fibers as well as non-elongated particles. The methods and fluid compositions disclosed herein for ESD solvent ejection and particle formation can be advantageously employed for forming polymer fibers (including polymer nanofibers, e.g., fibers having an average diameter less than about 500 nm) in larger quantities at faster rates than conventional electrospinning. In conventional electrospinning (FIG. 4), the jet 442 typically remains intact over ten or more centimeters after emerging from the Taylor cone 444. After the first several centimeters, the jet 442 begins to elongate and whip due to electrostatic interactions before being deposited on a collecting surface; however, the jet 442 typically remains intact until it is deposited. Solvent evaporates from the jet 442, and the collecting surface typically must be located about 10 to 20 centimeters from the emitter 402 to allow sufficient solvent evaporation to leave the deposited fibers substantially devoid of solvent.

In contrast, in ESD solvent ejection (FIG. 3) the polymer particles 348 appear in the high-speed photography to be ejected from the jets 342 in a direction substantially transverse to the emitter (e.g., substantially transverse with respect to nozzle 102) within about 2 to 3 mm of their corresponding points of formation, i.e., where the jets 342 break up and eject solvent. The polymer fibers 348 appear to be ejected at a substantially lower velocity than the ejected solvent droplets 346, thereby effecting a separation. The polymer particles 348 are deposited on a collection surface 130, as described further below. In addition to high-speed photographic evidence of an ESD solvent ejection mechanism that is non-evaporative, further evidence for such a mechanism includes the observation that polymer fibers 348, substantially devoid of the liquid solvent, can be deposited on a collection surface 130 that is less than about 1 cm away from the emitter orifice 104 (i.e., distance d in FIG. 1 less than about 1 cm; d≈0.5 cm has been employed), using a solvent such as, e.g., d-limonene that has a relatively high boiling point (176° C.) and a relatively low vapor pressure (2 mm Hg at 20° C.). Calculations indicate that an evaporative solvent removal mechanism could not remove such a high-boiling solvent over such a small distance. Therefore, a non-evaporative ESD solvent ejection mechanism can be inferred from the deposition of essentially solvent-free fibers with the emitter orifice 104 less than a centimeter from the collection surface 130.

In the example of FIG. 1, polymer fibers 348 are deposited on a collection surface 130 that is positioned between the emitter orifice 104 and an electrically grounded surface 120 (typically conductive and in the example of FIG. 1 connected via wire 122 to a common ground with power supply 110; can be referred to as a "counter electrode" or "ground plane"). Electrostatic interactions arising from the presence of grounded surface 120 tend to propel the polymer fibers 348 toward the collection surface 130. However, the collection surface 130 itself need not be conductive, and preferably is insulating or only slightly conductive, to reduce the likelihood of arcing at higher applied voltage. The arrangement of FIG. 1 can be employed to deposit polymer fibers onto a wide variety of slightly conductive or electrically insulating collection surfaces 130, including but not limited to paper or other cellulosic material, fibrous or textile materials, polymer films such as Mylar (i.e., biaxially-oriented polyethylene terephthalate or boPET), Saran (i.e., polyvinylidene chloride), or polytetrafluoroethylene, or composite materials such as fiberglass. Although the grounded surface 120 is shown in FIG. 1 as being larger in transverse extent than the collection surface 130, this need not be the case. In fact, it can be advantageous to arrange the collection surface 130 to effectively block any potential charge transfer between the fluid jet and the grounded surface 120, in effect "breaking the circuit" that would be formed by the high voltage supply 110, the fluid, the grounded surface 120, and common ground connection 122 (e.g., as in conventional electrospinning). When collecting polymer fibers on a slightly conductive material (e.g., cellulosic paper), fiber collection rates can be increased by interposing an impermeable, insulating layer (e.g., a Mylar sheet) between the grounded surface 120 and the collection surface 130. The presence of grounded surface 120 preferably serves only to define the electrostatic field lines, but is not intended to carry any substantial current.

In the arrangement of FIG. 1 (with a grounded surface 120 connected to a common ground 122 with the power supply 110), the distance d between the nozzle orifice 104 and the collection surface can be as small as about 0.5 cm or about 1 cm or can be as large as about 10-15 cm or more (provided the applied voltage is sufficiently large, e.g., greater than about 5 kV per centimeter of separation between the nozzle orifice 104 and the grounded surface 120). Solvent is ejected from the jets 342 within about 2-3 mm, enabling deposition of polymer fibers 348 onto collection surface 130 substantially devoid of solvent even at a distance of less than 1 cm for a single nozzle. It has been observed in a multiple nozzle arrangement, however, that solvent ejected from the jets of adjacent nozzles can be deposited along with the fibers of those nozzles, for example, when the nozzles are about 3 cm apart and the collection surface is closer than about 10 cm. Larger nozzle-to-surface distance d or higher applied voltage, optionally coupled with gas-flow-based solvent recovery (if needed or desired), can be employed to yield deposited fibers substantially devoid of solvent in a multiple nozzle arrangement.

Figure 5A:
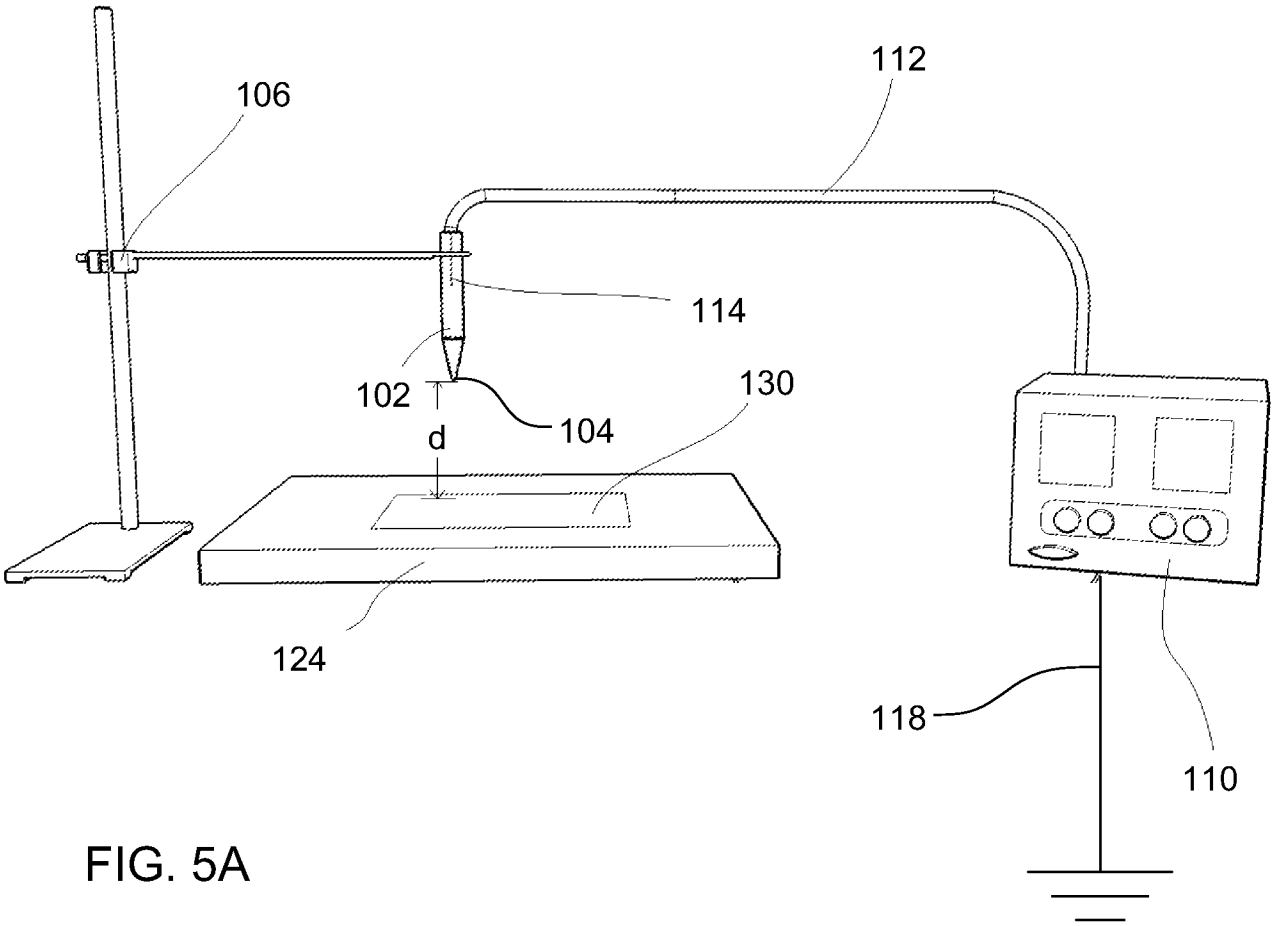
FIG. 5A illustrates schematically another exemplary apparatus for ESD solvent ejection or particle formation.

In another exemplary arrangement for ESD solvent ejection, illustrated schematically in FIG. 5A, the collection surface 130 is positioned on an electrically isolated surface 124 that acts merely as a mechanical support, with no adjacent or juxtaposed ground plane or counter electrode. The high voltage supply 110 remains grounded through ground connection 118. The general surroundings (e.g., furnishings, other nearby equipment, walls, floor, ceiling, or the earth's surface) will typically provide some effective "ground," typically distant enough to only negligibly affect behavior of the fluid jets 342 or polymer fibers 348. Support surface 124 can be omitted if the collection surface 130 is sufficiently rigid to be self-supporting. When the arrangement of FIG. 5A is employed, the ejected polymer fibers tend to be ejected transversely from the jets 342 over a transverse distance up to about 10 or more cm in all directions and then tend to drift somewhat aimlessly. To effect deposition of the polymer fibers 348 onto the collection surface 130, gas flow (positive or negative pressure, e.g., provided by a blower, vacuum belt, or similar device) or other standard means can be employed to propel the polymer fibers onto the collection surface 130. Instead or in addition, gas flow can be employed to collect or recover the ejected solvent, as droplets or as vapor (as noted above). Any suitable gas can be employed, including ambient air; ionized gas can be employed and in some circumstances has been observed to enhance ESD solvent ejection by stabilizing the jets 342 and/or suppressing corona discharge from the nozzle. In the exemplary arrangement of FIG. 6, the collection surface comprises living tissue 132 and no adjacent or juxtaposed ground plane or counter electrode is employed.

Figure 5B:
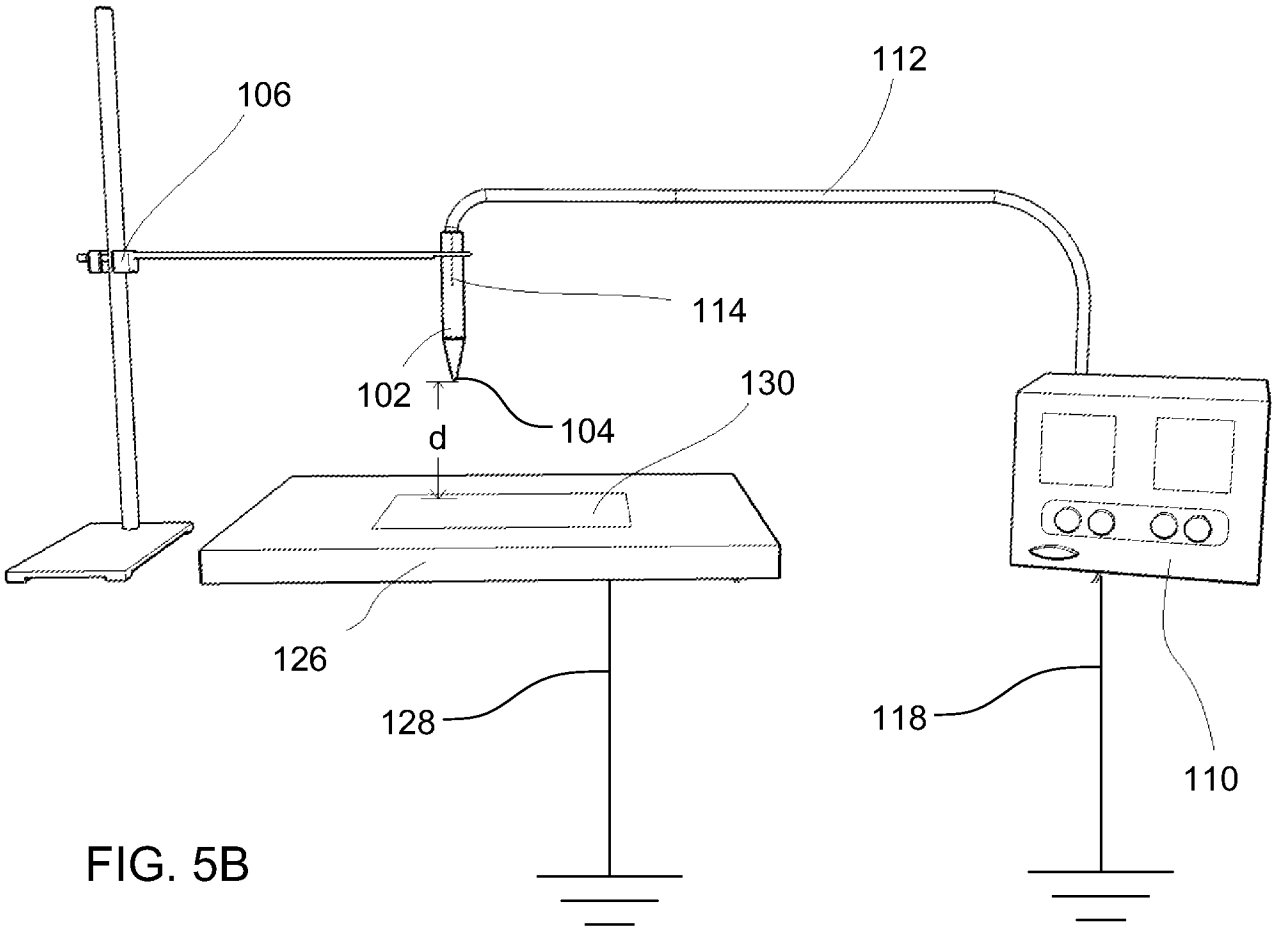
FIG. 5B illustrates schematically another exemplary apparatus for ESD solvent ejection or particle formation.

The exemplary arrangement illustrated schematically in FIG. 5B includes a surface 126 that is grounded through a ground connection 128 that is not connected directly to ground connection 118 of the high voltage supply 110. Such a ground connection shall be referred to as "indirect," as opposed to the "direct" ground connection 122 shown in FIG. 1. At smaller nozzle-surface separations (e.g., separation less than about 10 cm with greater than about 5 kV per cm of separation), the arrangements of FIGS. 1 and 5B behave similarly. However, the arrangement of FIG. 5B (that includes only an indirect ground connection 128 to surface 126) is observed to exhibit, at larger separations between the nozzle orifice and grounded surface 120, behavior distinct from that exhibited by the arrangement of FIG. 1 (that includes a direct ground connection 122 to surface 120). In either arrangement, for example, an applied voltage of about 15 kV and a nozzle-surface separation of about 3 cm results in ESD solvent ejection. However, movement of the grounded surface 120 away from the nozzle orifice 104 eventually quenches the ESD solvent ejection in the arrangement of FIG. 1 (e.g., at a separation greater than about 5 cm). Such quenching of ESD solvent ejection is not observed in the arrangement of FIG. 5B; in some instances, the flow rate per nozzle has been observed to increase at substantially larger separations.

At such substantially larger nozzle-surface separations (e.g., up to 30 cm, 40 cm, 50 cm, or more), the behavior of the arrangement of FIG. 5B resembles the behavior of the arrangement of FIG. 5A (with an isolated collection surface and no ground surface). The observed difference in behavior of the arrangements of FIGS. 1 and 5B can be exploited to achieve greater flow rates or polymer fiber deposition rates by eliminating a direct ground connection between the high voltage supply 110 and a collection surface 130 or ground surface 126. For example, in a manufacturing environment with nozzles arranged so that the deposited polymer fibers are collected on a substrate moving along a conveyor, various metal components of the conveyor can act as surface 126 that has an indirect ground connection 128, i.e., separate from the ground connection 118 of the high voltage supply 110. Enhanced polymer fiber collection rates can be thereby achieved, relative to those obtained if the high voltage supply and conveyor shared a direct, common ground connection. An indirect ground connection can be realized in a variety of ways, e.g., by connection to separate electrical outlets, by connection to separate, distinct circuits of a building's electrical wiring, or by connection of the surface 126 to literal earth ground while high voltage supply is grounded through building wiring; other indirect ground connections can be employed.

It has been observed that emitting the fluid jets 342 and fibers 348 into a larger, unimpeded volume of space appears to enhance the flow rate of the fluid composition through the emitter. A collection surface 130 positioned 30 cm, 40 cm, or 50 cm from the nozzle 102, or even farther, appears to result in increased flow rates of the fluid composition through the nozzle orifice 104 (in the arrangements of FIGS. 5A and 5B, for example). The larger volume available may at least partly account for the enhanced flow rates exhibited by FIGS. 5A and 5B (at large separations) relative to FIG. 1 (at smaller separation). Enhancement of flow rate of up to about 50% or more has been observed relative to flow rates with the collection surface less than about 5 cm from the nozzle 102. At such large distances, the presence or absence of an indirectly grounded surface 126 only minimally affects the behavior of jets 342 or polymer fibers 348. The combined effect of a relatively large transverse "cloud" of polymer fibers produced by each nozzle at an enhanced flow rate can be advantageously employed for depositing large amounts of polymer fibers over a relatively wide area.

Figure 6:
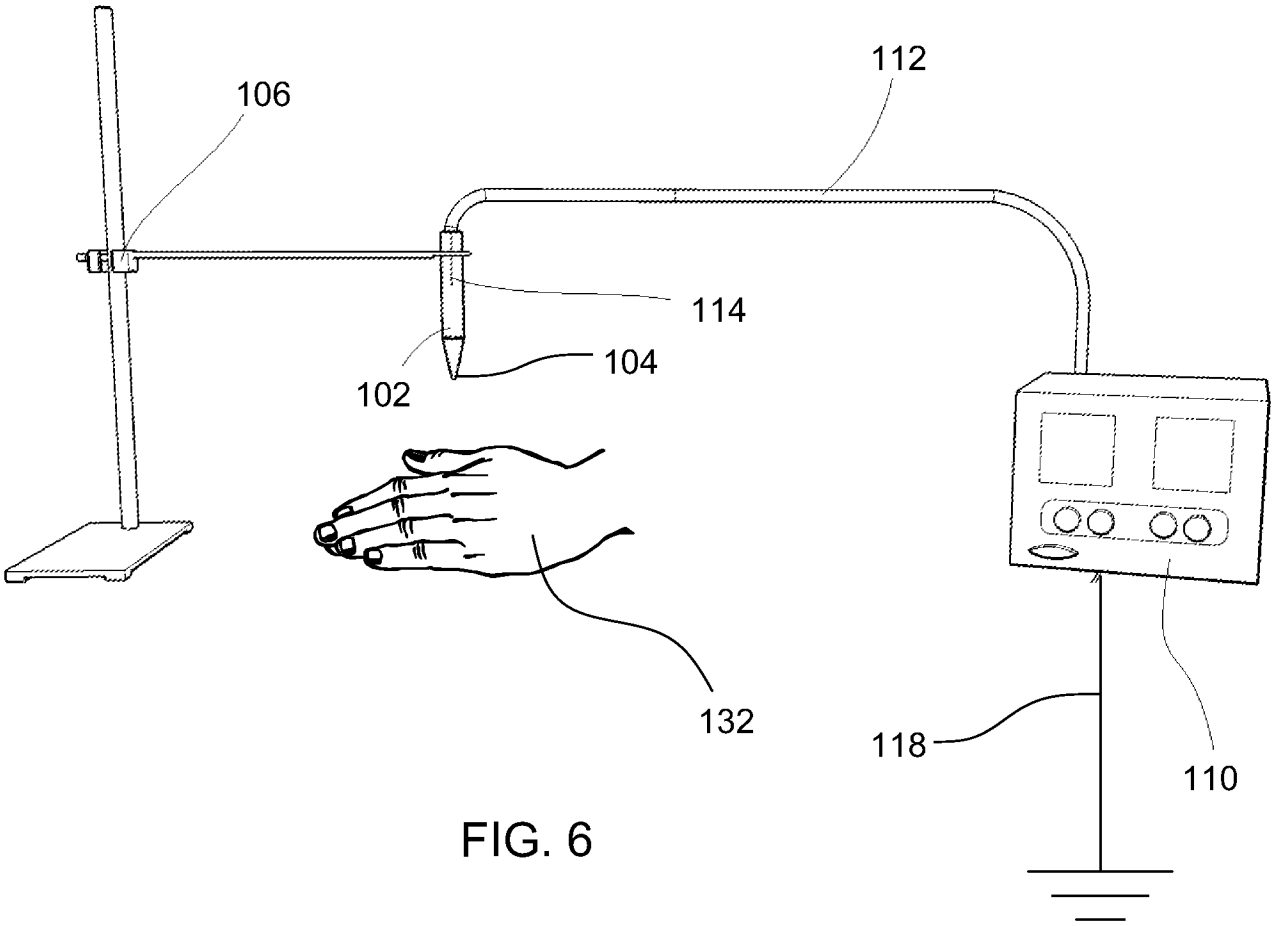
FIG. 6 illustrates schematically another exemplary apparatus for ESD solvent ejection or particle formation.
Figure 7:
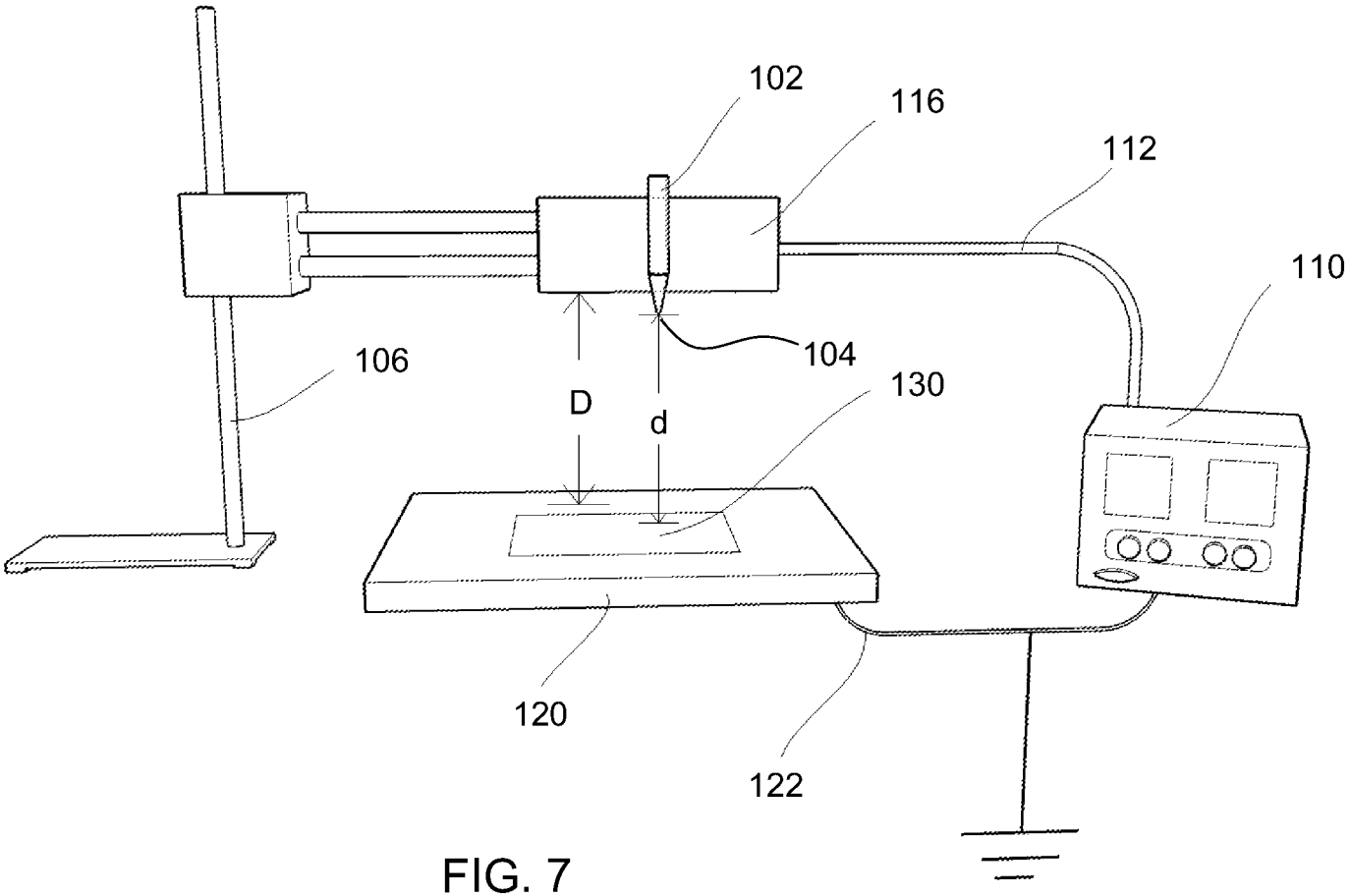
FIG. 7 illustrates schematically another exemplary apparatus for ESD solvent ejection or particle formation.
Figure 8:
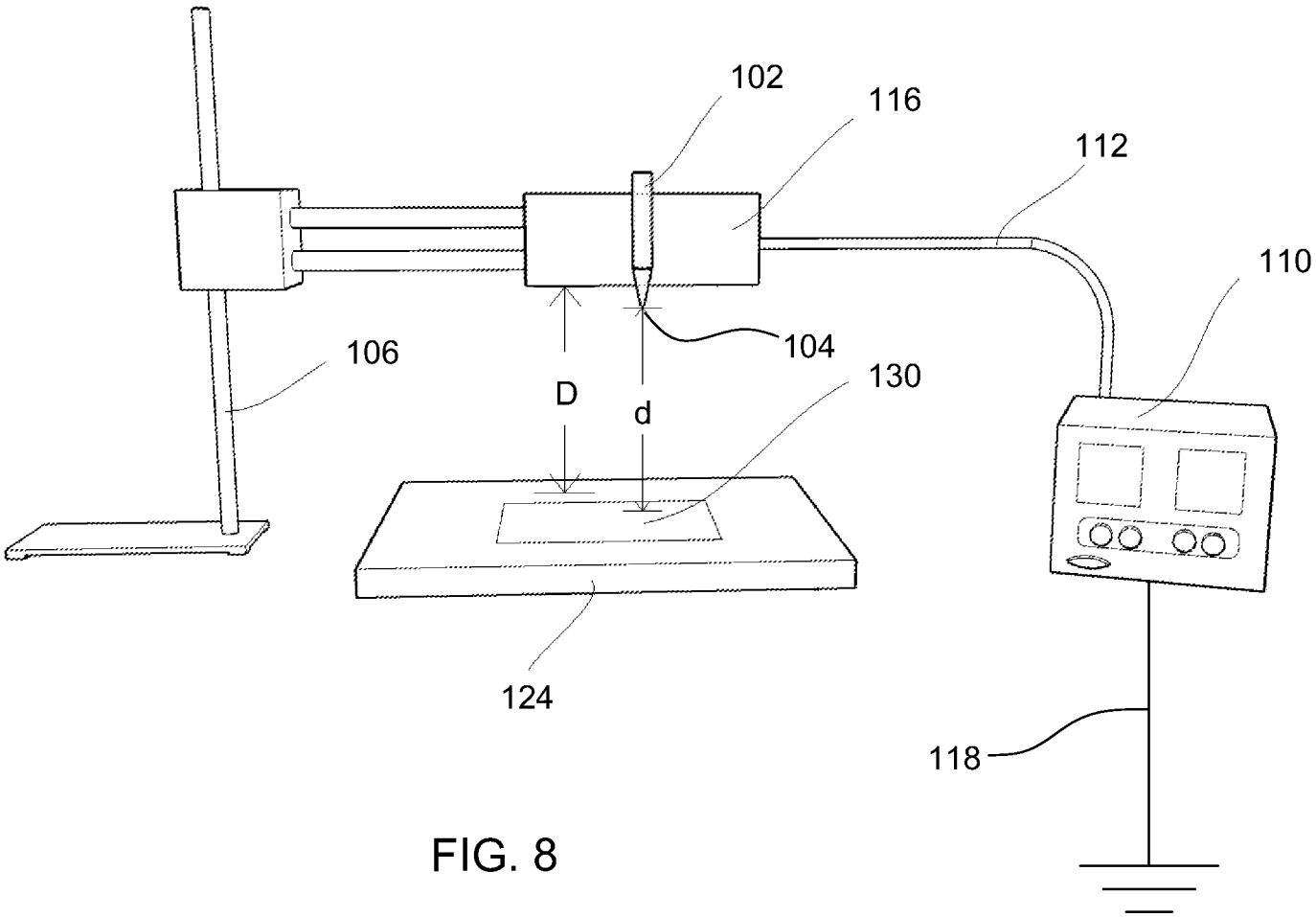
FIG. 8 illustrates schematically another exemplary apparatus for ESD solvent ejection or particle formation.

The exemplary arrangements of FIGS. 7 and 8 correspond to those of FIGS. 1 and 5A, respectively, except that the immersed electrode 114 is replaced by an external electrode 116 positioned outside and adjacent the emitter 102. The external electrode 116 is positioned upstream from the emitter orifice 104, i.e., the external electrode 116 is positioned so that the emitter 102 points substantially away from the electrode 116. The distances D (electrode 116 to collection surface 130) and d (emitter orifice 104 to collection surface 130) can be varied independently. The arrangement of FIG. 7 is analogous to that of FIG. 1, in that the collection surface 130 is positioned between the emitter orifice 104 and a grounded surface 120. The arrangement of FIG. 8 is analogous to that of FIG. 5A, in that the collection surface 130 is electrically isolated, i.e., there is no counter electrode. The arrangement of FIG. 8 can also be used to deposit polymer fibers on living tissue, in a manner analogous to that shown in FIG. 6, or can include an indirect ground connection for a surface 126, as in FIG. 5B. In the arrangements of FIGS. 7 and 8, there is no direct conduction path between the fluid composition in the emitters 102 and the external electrode 116. In other words, there is no possibility of establishing a "circuit" comprising the high voltage supply 110, the fluid composition, and the collection surface 130.

Figure 9:
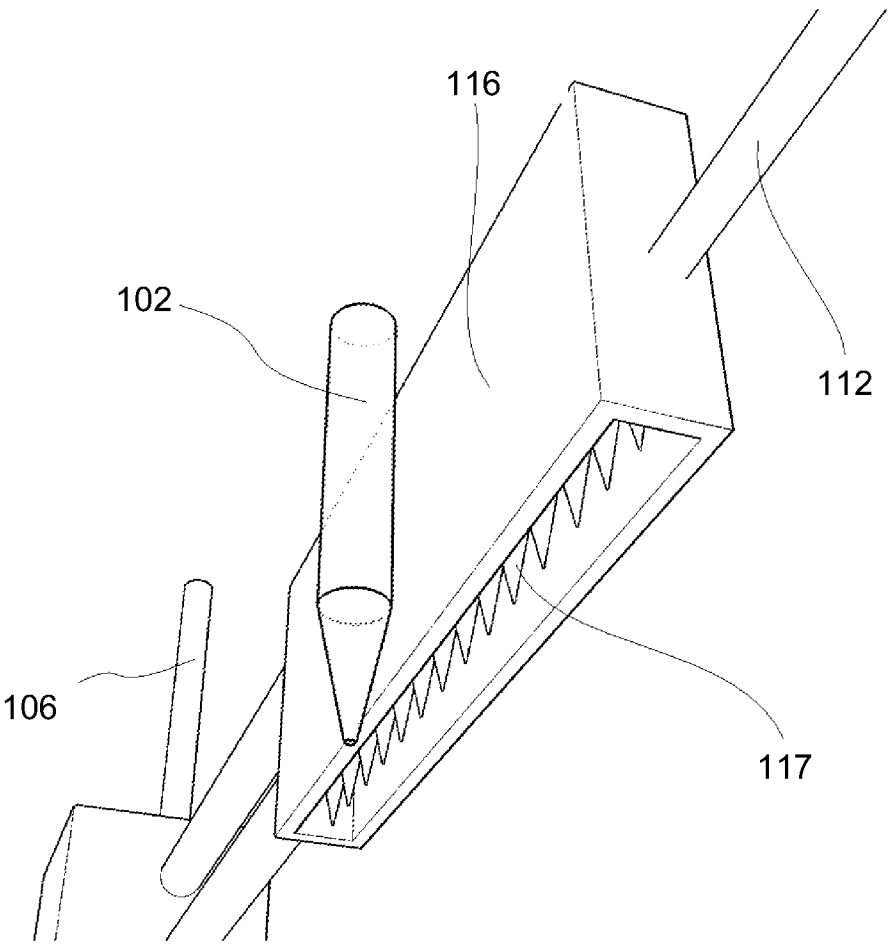
FIG. 9 illustrates schematically an exemplary external electrode for ESD solvent ejection or particle formation.

Any suitable external electrode 116 can be employed. FIG. 9 illustrates details of a particular type of electrode 116 that can be used. The exemplary electrode 116 depicted in FIG. 9 is a so-called ionization bar or "pinner" bar, and includes a plurality of ionization pins 117. Alternatively, the nozzles 102 can extend through one or more openings in a conductive plate electrode, as shown and described in App No. 61/256,873 (incorporated above).

Sufficiently large voltage (positive or negative) must be applied to the fluid composition via the electrode 114 or 116 to form polymer fibers by ESD solvent ejection from the emitted fluid composition. The precise voltage threshold can vary somewhat depending on the particular fluid composition being employed and the arrangement of the emitter 102 and collecting surface 130.

In the arrangements of FIGS. 1 and 7 (that include a grounded counter electrode surface 120), a voltage threshold for forming fluid jets depends on the distance between the emitter orifice 104 and the grounded surface 120, as well as the fluid composition and properties. Because the emitter 102 is non-conductive, quantifying the electric field strength or the electric field gradient near the emitter orifice 104 is problematic. However, the behavior of the fluid exiting the emitter orifice 104 can be correlated with the applied voltage divided by the distance d between the emitter orifice 104 and the grounded surface 120. That quantity (voltage-distance quotient; readily measured) should be distinguished from the electric field strength (not readily measured), despite the similarity of the units employed (i.e., kV/cm).

For the arrangements of FIGS. 1 and 7 (employing electrically insulating nozzles or emitters), with d less than about 10 cm or less than about 5 cm, the following progression of general fluid behaviors is often observed. The voltage ranges are approximate and can vary substantially among differing fluid compositions. Up to a voltage-distance quotient of about 3 kV/cm, conventional electrospinning from a single Taylor cone per emitter is typically observed, particularly when employing conventional, conductive electrospinning fluids. Flow rates are typically less than about 5 μL/min/emitter. With a voltage-distance quotient between about 3 kV/cm and about 5-6 kV/cm, conventional electrospinning is observed from multiple Taylor cones per emitter, with flow rates between about 5 and about 15 μL/min/emitter. Arcing between the fluid and the ground surface 120 (or any nearby grounded surface or object) may begin to occur, depending on the conductivity of the fluid, and may limit the voltage that can be applied to a particular fluid composition. With a voltage-distance quotient between about 5-6 kV/cm and about 10 kV/cm, a mixture of conventional electrospinning from multiple Taylor cones per emitter and non-evaporative, ESD solvent ejection is observed. The relative weight of those parallel processes shifts away from conventional electrospinning and toward non-evaporative, ESD solvent ejection as voltage is increased, as dielectric contrast of the fluid is increased, or as fluid conductivity is decreased. Flow rates between about 20 and about 300 μL/min/emitter are often observed, and tend to increase with applied voltage. Arcing tends to occur unless fluid conductivity is kept below about 1 mS/cm, preferably less than about 100 μS/cm, more preferably less than about 30 μS/cm or less than about 20 μS/cm. For voltage-distance quotients above 10 kV/cm, conventional Taylor cone electrospinning is substantially eliminated and non-evaporative, ESD solvent ejection predominates. Conventional electrospinning solutions typically cannot be employed due to arcing. Using fluid compositions and electrode/emitter/target arrangements disclosed herein, flow rates from several hundred μL/min/nozzle up to and over 1 mL/min/nozzle have been observed, enabling polymer fiber deposition rates greater than about 0.5 g/hr/nozzle, often up to several g/hr/nozzle.

In the arrangement of FIGS. 5A, 6, and 8 (no counter electrode), there is no well-defined distance that correlates with the behavior of the fluid exiting the emitter orifice 104; the only measured parameter that correlates with that fluid behavior is the applied voltage relative to earth ground. A voltage threshold is observed between about 10 kV and about 15 kV, and appears to vary with the composition and properties of the fluid (e.g., dielectric constant, conductivity, and/or viscosity). Above the threshold voltage, the presently disclosed, non-evaporative, ESD solvent ejection with concomitant particle formation is observed. At lower applied voltages (still above the threshold voltage), conventional electrospinning from a visible Taylor cone can sometimes also be observed. As the voltage increases further beyond the threshold, conventional Taylor cone electrospinning tends to be suppressed or eliminated, while non-evaporative, ESD solvent ejection is enhanced. As noted above, the arrangement of FIG. 5B (including an indirect ground connection 128 for surface 126) exhibits both types of behavior (i.e., similar to FIG. 1 or similar to FIG. 5A), depending on the nozzle-surface distance and the applied voltage.

Another characteristic that distinguishes the methods and fluid compositions disclosed herein from conventional electrospinning with conventional fluids becomes apparent when the applied voltage is turned off. Conventional Taylor cone electrospinning ceases almost immediately upon turning off the voltage supply. In contrast, when using a low conductivity, high dielectric contrast fluid in any of the arrangements of FIG. 1, 5A, 5B, 6, 7, or 8, the non-evaporative, ESD solvent ejection and polymer fiber formation continues, often for several minutes. A progression of behaviors of the fluid exiting the nozzle orifice 104 is typically observed. Just after the voltage is turned off, there is little change in the behavior fluid jets 342 exiting the emitter orifice 104. Over the course of several minutes, (1) some multiple Taylor cone electrospinning begins to occur along with the ESD solvent ejection, (2) the ESD solvent ejection stops, (3) the Taylor cone electrospinning is reduced to a single cone and jet, and (4) the last jet stops. During the progression, dripping sometimes occurs, and as each drop separates from the fluid in the emitter a brief spurt of multiple fluid jets occurs, which diminish in intensity and duration with each successive drop.

The continuation of fluid jets exiting the nozzle orifice 104 after the applied voltage is turned off is indicative of at least one characteristic relaxation time of the system, and that characteristic relaxation time can be exploited to enhance the ESD solvent ejection process and formation of polymer fibers (and to reduce any parallel Taylor cone electrospinning by the duty cycle of the voltage cycling). By cycling the applied voltage on and off at a frequency on the order of the reciprocal of the relevant relaxation time, enhancement of non-evaporative, ESD solvent ejection can be achieved. Rather than attempting to measure or characterize the relevant relaxation time, it can be more expedient to vary the frequency at which the applied voltage is cycled and note which frequency (or range of frequencies) appear to enhance the desired ESD solvent ejection process. For non-evaporative, ESD solvent ejection, suitable frequencies for enhancement have been observed between about 0.1 Hz and about 100 Hz.

Polymer fibers formed by the methods disclosed herein using fluid compositions having high dielectric contrast and low conductivity can be advantageously employed for a wide variety of purposes, particularly when the fibers formed are nanofibers, i.e., have diameters less than about 1 μm, or typically less than about 500 nm. Such purposes can include but are not limited to filtration, protective gear, biomedical applications, or materials engineering. For example, a mesh of polymer nanofibers can form at least a portion of a filtration medium that transmits only particles smaller than about 1 μm. In another example, a matrix of polymer nanofibers can be employed to retain small particles (e.g., less than 0.1 μm) of other materials (e.g., super absorbent polymers, zeolites, activated charcoal, or carbon black) to yield a material having various desired properties. A full discussion of the many uses of the fibers thus formed is beyond the scope of this disclosure. A wide array of polymers, liquid solvents, low-dielectric liquid solvents (e.g., dielectric constant less than about 15), high-dielectric materials (e.g., dielectric constant greater than about 25), salts, surfactants, and/or ionic liquids can be employed, depending on the desired properties of the nanofibers produced, and many examples are given below. For a given polymer to be deposited on a given collection surface, some optimization of parameters typically will be required to produce suitable or optimal fibers or nanofibers. Those parameters can include: identity, dielectric constant, and weight percent of the low-dielectric solvent; presence, identity, and weight percent of the high-dielectric material, salt, surfactant, or ionic liquid; presence, identity, and weight percent of any additional high dielectric material(s); conductivity and viscosity of the fluid composition; nature of the emitter (e.g., nozzle(s), channel(s), or permeable membrane), emitter orifice diameter; emitter hydrodynamic resistance; applied voltage; presence of a grounded surface and its distance from the emitter orifice; distance between the emitter orifice and the collection surface. The principles and examples disclosed herein will enable those skilled in the art to identify and optimize many other combinations of polymer, low-dielectric solvent, and high-dielectric material that are not explicitly disclosed herein that yield desirable polymer fibers or nanofibers; those other combinations, and the fiber or nanofibers thus produced, shall fall within the scope of the present disclosure or the appended claims.

Many combinations of chemically compatible and sufficiently soluble polymers, high-dielectric materials, salts, surfactants, or ionic liquids can be employed with a given solvent to produce a fluid composition that exhibits ESD solvent ejection. Table 1 is a list of examples of fluid compositions that exhibit ESD solvent ejection; those that include a polymer have been employed according to the methods disclosed herein to produce polymer fibers or nanofibers by ESD solvent ejection. The listed formulations are exemplary, are intended to illustrate general principles guiding selection of fluid components, and are not intended to limit the overall scope of the present disclosure or appended claims. However, specific disclosed exemplary formulations, or ranges of formulations, can be considered preferred embodiments and may therefore be further distinguished from the prior art on that basis.

TABLE 1 fluid compositions yielding polymer nanofibers by ESD solvent ejection

| polymer | solvent | high-dielectric, ionic liquid, or salt | intermediate dielectric | intermediate dielectric |
|---|---|---|---|---|
| polystyrene 23.4% | d-limonene 62.3% | [P66614] [R2PO2] 0.68% | acetone 13.7% | |
| polystyrene 17.2% | d-limonene 40.1% | DMSO 10.0% | acetone 32.7% | |
| polystyrene 17.2% | d-limonene 40.0% | [P66614] [R2PO2] 0.05% | DMSO 10.0% | MEK 32.7% |
| polystyrene 17.2% | d-limonene 40.1% | DMSO 10.0% | MEK 32.8% | |
| polystyrene 17.2% | d-limonene 40.1% | [P66614] [R2PO2] 0.05% | DMSO 10.0% | acetone 32.7% |

TABLE 1-continued fluid compositions yielding polymer nanofibers by ESD solvent ejection

| polymer | solvent | high-dielectric, ionic liquid, or salt | intermediate dielectric | intermediate dielectric |
|---|---|---|---|---|
| polystyrene 17.2% | d-limonene 40.1% | [P66614] [Dec] 0.05% | DMSO 10.0% | MEK 32.7% |
| polystyrene 15.6% | d-limonene 36.5% | PC 18.1% | MEK 29.7% | |
| polystyrene 17.2% | d-limonene 40.2% | [P66614] [Dec] 0.05% | PC 10.0% | MEK 32.6% |
| polystyrene 29.4% | d-limonene 68.6% | $BaTiO_3$ 2.0% | | |
| polystyrene 18.7% | d-limonene 43.7% | $BaTiO_3$ 1.3% | [P66614][Dec] 0.05% | MEK 36.2% |
| polystyrene 20.0% | d-limonene 56.5% | $TiO_2$ 0.1% | [P66614][Dec] 0.05% | MEK 23.3% |
| polystyrene 21.0% | d-limonene 50.0% | [bmim][PF6] 0.5% | MEK 28.0% | |
| PVP 25.4% | EtOH 74.6% | | | |
| PVP 25.0% | MeOH 75.0% | | | |
| PVAc 15.0% | MeOH 85.0% | | | |
| PVAc 15.1% | DCM 84.9% | | | |
| PVAc 8.3% | DCM 91.7% | | | |
| PVP 15.0% | DCM 85.0% | | | |
| polystyrene 22.37% | d-limonene 67.12% | [bmim][PF6] 0.056% | DMF 10.45% | |
| polystyrene 26.86% | d-limonene 61.76% | $TiO_2$ 0.90% | MEK 10.43% | [bmim][PF6] 0.05% |
| polystyrene 28.21% | d-limonene 65.25% | $TiO_2$ 0.94% | MEK 5.55% | [bmim][PF6] 0.05 |
| polystyrene 26.85% | d-limonene 61.69% | $TiO_2$ 0.89% | DMF 10.5% | [bmim][PF6] 0.06% |
| polystyrene 28.3% | d-limonene 65.13% | $TiO_2$ 0.94% | DMF 5.57% | [bmim][PF6] 0.05% |
| polystyrene 19.67% | d-limonene 62.3% | tap water 16.39% | DeMULS DLN-532CE 1.64% | |
| polysulfone 21.41% | d-limonene 26.1% | [bmim][PF6] 2.55% | NMP 9.99% | DMF 39.96% |
| polystyrene 17.48% PCMS 18.92% | d-limonene 40.79% | [bmim][PF6] 0.091% | DMF 22.72% | |
| polystyrene 17.94% PCMS 19.64% | d-limonene 53.83% | [bmim][PF6] 0.053% | DMF 8.52% | |
| polystyrene 19.9% PCMS 7.69% | d-limonene 46.44% | [bmim][PF6] 0.096% | DMF 25.86% | |
| PEI 15.9% | d-limonene 53.83% | KCl 0.9% | NMP 49.18% | DMF 13.62% |

In some exemplary compositions, ESD solvent ejection and formation of polymer fibers or nanofibers has been demonstrated with fluid compositions based on polystyrene dissolved in d-limonene, in combination with a variety of high-dielectric materials and/or other materials. Other aromatic polymers and/or other terpene, terpenoid, or aromatic solvents have been observed to exhibit similar behavior. D-limonene is attractive for use as the liquid solvent because it is considered "green" (e.g., it is available from natural, renewable sources, lacks significant toxicity, and does not raise significant environmental or disposal issues). In one group of exemplary fluid compositions, polystyrene typically comprises between about 10% and about 25% of the composition by weight, preferably between about 15% and about 20%. D-limonene typically comprises between about 30% and about 70% of the composition by weight, preferably between about 35% and about 45%. A variety of high-dielectric materials can be employed with polystyrene/d-limonene that result in ESD ejection of the d-limonene solvent and production of polystyrene fibers or nanofibers. Propylene carbonate (PC), dimethyl sulfoxide (DMSO), and dimethyl formamide (DMF) have been employed as a high-dielectric material, alone or in combination with methyl ethyl ketone (MEK) or acetone used as an intermediate dielectric material. Intermediate dielectric materials can often be employed to increase the solubility of the high-dielectric material in the polystyrene/limonene (or other polymer/low-dielectric) solution, forming a so-called "dielectric ladder." In another exemplary fluid composition, water is employed as the high dielectric material in a polystyrene/d-limonene solution, with DeMULS DLN-532CE surfactant (DeForest Enterprises, Inc) acting as an emulsifier to enable mixing of the water into the d-limonene solution. Polyvinyl alcohol, a soap, a detergent, or other emulsifying agent can be employed.

Ionic liquids (e.g., trihexyltetradecylphosphonium bis(2,4,4-trimethylpentyl) phosphinate aka [P66614][R2PO2], trihexyltetradecylphosphonium decanoate aka [P66614][Dec], or 1-butyl-3-methylimidazolium hexafluorophosphate aka [bmim][PF6]) have been employed as high-dielectric components, with various combinations of PC, DMSO, MEK, and acetone employed as intermediate steps in the dielectric ladder. Various inorganic salts (e.g., LiCl, $AgNO_3$, $CuCl_2$, or $FeCl_3$) have been employed, in combination with DMF, MEK, or N-methyl-2-pyrrolidone (NMP), as disclosed in application Ser. No. 12/728,070, already incorporated by reference. It has been observed that as the dielectric ladder is ascended, progressively lower material concentrations are required for the fluid to exhibit ESD solvent ejection. Note for example the relative concentrations of the various materials in the exemplary compositions listed in Table 1. Solid particles suspended in the fluid can act as the high-dielectric material in a high dielectric contrast composition, with or without intermediate "dielectric ladder" components. Barium titanate ($BaTiO_3$) and titanium oxide ($TiO_2$) have been employed and can give rise to ESD solvent ejection, alone in a polystyrene/d-limonene solution, or in combination with other fluid components mentioned here or listed in Table 1.

In some other exemplary compositions, ESD solvent ejection and formation of polymer fibers or nanofibers has been demonstrated with fluid compositions based on polysulfone dissolved in d-limonene, in combination with DMF, NMP, and an ionic liquid. In some typical examples, polysulfone comprises between about 15% and about 30% of the composition by weight, d-limonene comprises between about 20% and about 30% of the composition by weight, NMP comprises between about 5% and about 20% by weight, DMF comprises between about 20% and about 40% by weight, and the ionic liquid comprises between about 1.5% and about 3% by weight.

In some other exemplary compositions, ESD solvent ejection and formation of polymer fibers or nanofibers has been demonstrated with fluid compositions based on mixtures of polystyrene and polycarbomethylsilane (PCMS) dissolved in d-limonene, in combination with DMF and an ionic liquid. In some typical examples, polystyrene comprises between about 15% and about 25% of the composition by weight, PCMS comprises between about 5% and about 20% by weight, d-limonene comprises between about 40% and about 55% of the composition by weight, DMF comprises between about 5% and about 30% by weight, and the ionic liquid comprises between about 0.05% and about 0.2% by weight.

The use of PCMS in combination with polystyrene, and UV curing of the resulting deposited polymer material, can be employed to form nanofibers to increase the heat resistance of the of those nanofibers. For example, nanofibers formed from polystyrene alone are observed to melt at about 127° C. That temperature may in some instances be too low for the nanofibers to withstand subsequent processing of the material on which they are deposited. In one example of a filtration medium, the medium is heated to about 190° C. for at least 30 seconds, resulting in melting of the deposited polystyrene nanofibers. It has been observed, however, the use of PCMS in combination with polystyrene, and UV curing of the resulting nanofibers, enables the cured nanofibers to survive intact after being heated to about 190° C. for several minutes. A mercury lamp (maximum output at a wavelength of 254 nm) can be employed for curing the polystyrene/PCMS nanofibers, and using a lamp producing about 50 W at 254 nm for a curing time on the order of an hour provides adequate curing. That curing time can be reduced by using a higher wattage lamp or by increasing the fraction of the lamp output that impinges on the fibers (e.g., using focusing or collecting optics).

In still other exemplary compositions, ESD solvent ejection and formation of polymer fibers or nanofibers has been demonstrated with fluid compositions based on polyetherimide (PEI) dissolved in d-limonene, in combination with DMF, NMP, and a salt. In some typical examples, PEI comprises between about 10% and about 25% of the composition by weight, d-limonene comprises between about 15% and about 25% of the composition by weight, NMP comprises between about 20% and about 60% by weight, DMF comprises between about 5% and about 25% by weight, and the salt comprises between about 0.25% and about 4% by weight.

Low conductivity polymer solutions (less than about 100 μS/cm), without substantial material components in addition to the polymer and solvent, have also been demonstrated to exhibit ESD solvent ejection and polymer fiber formation. Examples include solutions of polyvinylpyrrolidone (PVP) and polyvinylacetate (PVAc) dissolved in ethanol (EtOH), methanol (MeOH), or dichloromethane (DCM) and observed to exhibit ESD solvent ejection. For high dielectric solvents, such solutions can be regarded as exhibiting high dielectric contrast, between polymer (typically having a dielectric constant less than about 5) and solvent. This is the case for the MeOH and EtOH formulations. However, the DCM formulations do not exhibit a similar degree of dielectric contrast with the polymers, but nevertheless exhibit ESD solvent ejection under certain conditions. For PVP and PVAc solutions in DCM, ESD solvent ejection is appears to be inhibited by the viscosity of the polymer solution. For example, for PVP in DCM, a 25% PVP solution (viscosity about 67 cps) was observed not to exhibit ESD solvent ejection, while a 15% PVP solution in DCM (viscosity about 20 cps) did exhibit ESD solvent ejection. A similar trend was noted for solutions of PVAc in DCM. The apparent quenching of ESD solvent ejection by high viscosity is more readily apparent in solvents having a dielectric constant less than about 10 than in higher dielectric solvents. Other polymer/solvent combinations can be employed, but a minimum threshold dielectric constant of the solvent between about 6 and about 8 seems to be required for the solvent to exhibit ESD solvent ejection.

In addition to forming polymer fibers or nanofibers, additional particles can be deposited on the collection surface during collection of the polymer fibers, thereby retaining the additional particles in a matrix formed by the collected polymer fibers. Any suitable deposition method can be employed for depositing the additional particles that is compatible with formation of the polymer fibers. In one example, if air flow (e.g., from a vacuum belt) is employed to propel the polymer fibers to the collection surface as they are formed, that air flow can also entrain the additional particles and propel them to the collection surface as well. Whatever means are employed, simultaneous collection of the polymer fibers and deposition of the additional particles results in the additional particles being incorporated into a matrix formed by the collected fibers. If polymer nanofibers are formed, they can readily enable retention and immobilizations of additional particles that are as small as about 0.1 μm. The additional particles can comprise any suitable, desired material. In one example, super absorbent polymer particles (e.g., sodium polyacrylate) can be incorporated into a polymer nanofibers matrix in an absorbent product such as a diaper. In another example, zeolite or activated charcoal particles can be incorporated into a polymer nanofiber matrix in a filtration medium, resulting in both particulate and vapor interception capabilities. Additional examples abound.

Figure 10:
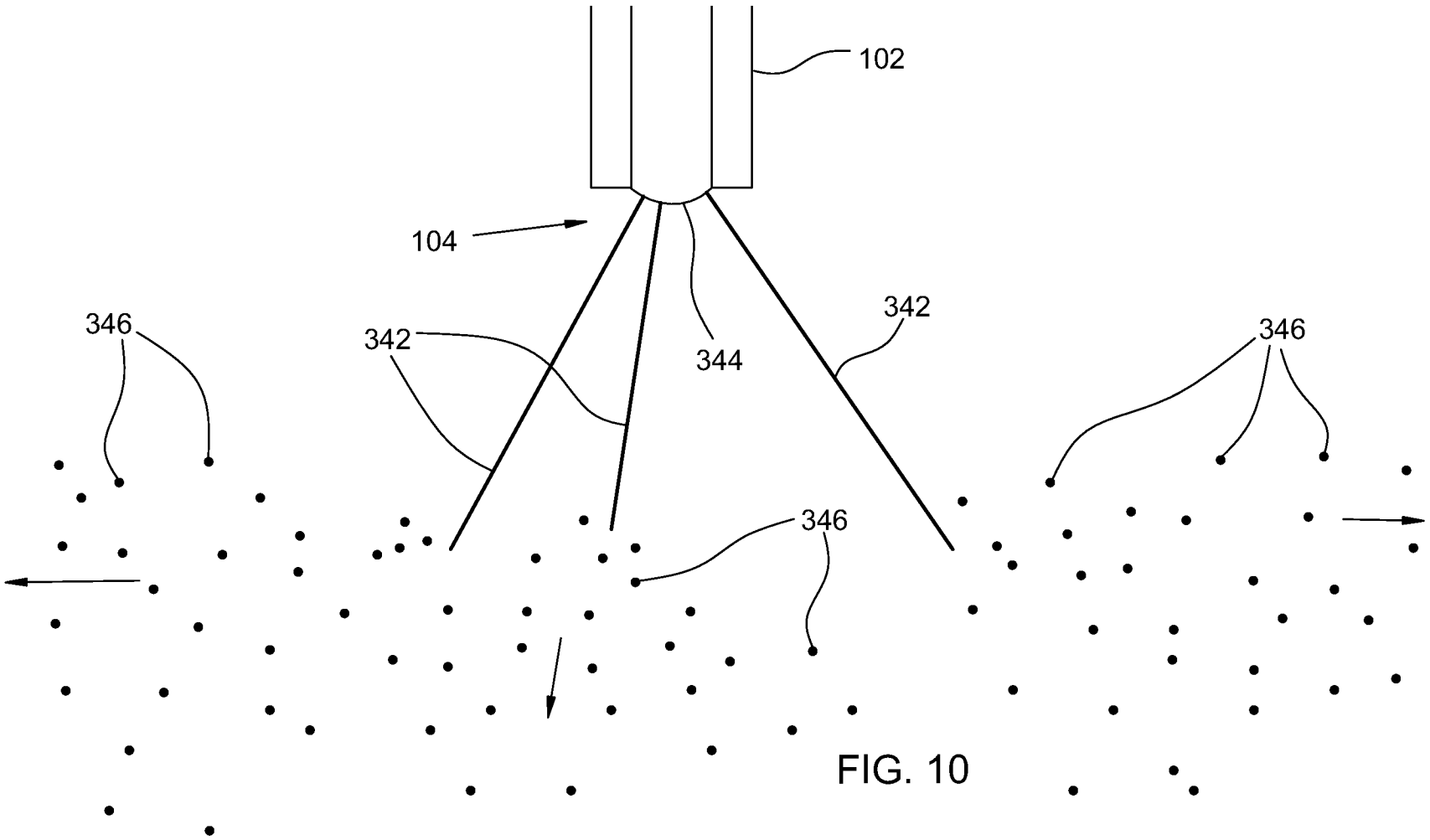
FIG. 10 illustrates schematically multiple fluid jets and solvent droplets ejected during ESD solvent ejection without particle formation.

In addition to producing polymer particles or fibers, methods disclosed herein can be employed for atomizing a low-dielectric solvent using a fluid composition comprising the low-dielectric liquid solvent and a high-dielectric constant additive, but no polymer. As illustrated schematically in FIG. 10, one or more fluid jets emerge from the fluid surface 344 at the emitter orifice 104. Within about 2 or 3 millimeters, the jets 342 eject solvent droplets 346 and break up. With no polymer present in the fluid, no particles or fibers are produced. The droplets produced under typical conditions (see above) appear to be less than about 2 μm in average diameter; other droplet diameters can be produced. The production of small solvent droplets can be advantageously employed in a variety of applications, e.g., for fuel injection into an engine cylinder or for spray treatment of a surface. Without any polymer in the fluid composition, fluid viscosity is likely to be quite low, which can be compensated by suitable adaptation of the emitter 102 and emitter orifice 104, e.g., to increase hydrodynamic resistance.

It is intended that equivalents of the disclosed exemplary embodiments and methods shall fall within the scope of the present disclosure or appended claims. It is intended that the disclosed exemplary embodiments and methods, and equivalents thereof, may be modified while remaining within the scope of the present disclosure or appended claims.

In the foregoing Detailed Description, various features may be grouped together in several exemplary embodiments to streamline the disclosure or to disclose preferred embodiments. This method of disclosure is not to be interpreted as reflecting an intention that any claimed embodiment requires more features than are expressly recited in the corresponding claim. Rather, as the appended claims reflect, inventive subject matter may lie in less than all features of a single disclosed exemplary embodiment, or in combinations of features that do not appear in combination in any single disclosed embodiment. Thus, the appended claims are hereby incorporated into the Detailed Description, with each claim standing on its own as a separate disclosed embodiment. However, the present disclosure and appended claims shall also be construed as implicitly disclosing any embodiment having any suitable combination of disclosed or claimed features (i.e., combinations of features that are not incompatible or mutually exclusive), including those combinations of features that are not explicitly disclosed herein. In particular, any suitable combination of parameters or features for performing the disclosed or claimed methods (e.g., any one or more of applied voltage, emitted-collector distance, emitter geometry, and so forth) can be combined with any suitable fluid composition (e.g., any suitable combination of one or more of specific polymer(s), solvent(s), dielectric material(s), and so forth). It should be further noted that the scope of the appended claims do not necessarily encompass the whole of the subject matter disclosed herein.

For purposes of the present disclosure and appended claims, the conjunction "or" is to be construed inclusively (e.g., "a dog or a cat" would be interpreted as "a dog, or a cat, or both"; e.g., "a dog, a cat, or a mouse" would be interpreted as "a dog, or a cat, or a mouse, or any two, or all three"), unless: (i) it is explicitly stated otherwise, e.g., by use of "either . . . or", "only one of . . . ", or similar language; or (ii) two or more of the listed alternatives are mutually exclusive within the particular context, in which case "or" would encompass only those combinations involving non-mutually-exclusive alternatives. For purposes of the present disclosure or appended claims, the words "comprising," "including," "having," and variants thereof shall be construed as open ended terminology, with the same meaning as if the phrase "at least" were appended after each instance thereof.

In the appended claims, if the provisions of 35 USC §112 ¶ 6 are desired to be invoked in an apparatus claim, then the word "means" will appear in that apparatus claim. If those provisions are desired to be invoked in a method claim, the words "a step for" will appear in that method claim. Conversely, if the words "means" or "a step for" do not appear in a claim, then the provisions of 35 USC §112 ¶ 6 are not intended to be invoked for that claim.

What is claimed is:

1. A method comprising:

introducing a fluid composition into one or more emitters, wherein (i) each emitter comprises an electrically insulating material and has a corresponding emitter orifice, (ii) the fluid composition comprises a first material having a dielectric constant greater than about 25 mixed into a liquid solvent having a dielectric constant less than about 15, (iii) the fluid composition further comprises a polymer dissolved, emulsified, or dispersed in the liquid solvent, and (iv) conductivity of the fluid composition is less than about 1 mS/cm;

applying a voltage to the fluid composition to cause non-evaporative ejection of the solvent from the fluid composition after the fluid composition exits the emitters through the corresponding emitter orifices; and collecting polymer particles, formed by ejection of the solvent from the fluid composition, on a collection surface, wherein the collected polymer particles comprise polymer fibers, wherein the fluid composition that exits the emitter orifice forms one or more discrete fluid jets, and each jet ejects solvent and breaks up within about 3 mm of its corresponding point of formation.

2. The method of claim 1 wherein conductivity of the fluid composition is less than about 100 μS/cm.

3. The method of claim 1 wherein the dielectric constant of the first material of greater than about 30.

4. The method of claim 1 wherein solvent is ejected from each fluid jet in a direction substantially transverse to the jet.

5. The method of claim 1 wherein the fluid jets emerge from a fluid meniscus at the emitter orifice.

6. The method of claim 1 wherein at least one of the discrete fluid jets forms without a corresponding Taylor cone that is visible outside the emitter orifice.

7. The method of claim 1 wherein the collected polymer particles are substantially devoid of the liquid solvent.

8. The method of claim 1 wherein the liquid solvent has a vapor pressure less than about 10 mm Hg at about 20° C., or has a boiling point greater than about 150° C. at one atmosphere.

9. The method of claim 1 wherein the fluid composition has a viscosity less than about 1000 centipoise.

10. The method of claim 1 wherein the fluid composition exits the emitters at a rate greater than about 100 μL/min/emitter.

11. The method of claim 1 wherein the polymer comprises polystyrene.

12. The method of claim 1 wherein the liquid solvent comprises a terpene, terpenoid, or aromatic solvent.

13. The method of claim 1 wherein the first material comprises DMF or NMP.

14. The method of claim 13 wherein the liquid solvent comprises a terpene, terpenoid, or aromatic solvent.

15. The method of claim 1 wherein the first material comprises a salt, a surfactant, or an ionic liquid, and the composition further comprises one or more of DMF, NMP, or MEK.

16. The method of claim 15 wherein the liquid solvent comprises a terpene, terpenoid, or aromatic solvent.

17. The method of claim 1 wherein the first material comprises solid particles suspended in the liquid solvent.

18. The method of claim 17 wherein the first material comprises titanium dioxide.

19. The method of claim 17 wherein the composition further comprises one or more of DMF, NMP, or MEK.

20. The method of claim 1 wherein the fluid composition further comprises a second material dissolved in the liquid solvent, which second material has a dielectric constant between that of the first material and that of the liquid solvent.

21. The method of claim 20 wherein the liquid solvent comprises a terpene, terpenoid, or aromatic solvent, the first material comprises a salt, a surfactant, or an ionic liquid, and the second material comprises one or more of DMF, NMP, or MEK.

22. A method comprising:

introducing a fluid composition into one or more emitters, wherein (i) each emitter comprises an electrically insulating material and has a corresponding emitter orifice, (ii) the fluid composition comprises a first material having a dielectric constant greater than about 25 mixed into a liquid solvent having a dielectric constant less than about 5; and (iii) the fluid composition further comprises a polymer dissolved, emulsified, or dispersed in the liquid solvent;

applying a voltage to the fluid composition to cause non-evaporative ejection of the solvent from the fluid composition after the fluid composition exits the emitters through the corresponding emitter orifices; and collecting polymer particles, formed by ejection of the solvent from the fluid composition, on a collection surface, wherein the collected polymer particles comprise polymer fibers, wherein the fluid composition that exits the emitter orifice forms one or more discrete fluid jets, and each jet ejects solvent and breaks up within about 3 mm of its corresponding point of formation.

23. The method of claim 22 wherein conductivity of the fluid composition is less than about 100 μS/cm.

24. The method of claim 22 wherein the dielectric constant of the first material of greater than about 30.

25. The method of claim 22 wherein the fluid composition further comprises a salt, a nonionic surfactant, an ionic surfactant, or an ionic liquid mixed into the liquid solvent, and conductivity of the fluid composition is less than about 1 mS/cm.

26. The method of claim 25 wherein conductivity of the fluid composition is less than about 100 μS/cm.

27. The method of claim 22 wherein conductivity of the fluid composition is less than about 50 μS/cm.

28. The method of claim 22 wherein conductivity of the fluid composition is less than about 30 μS/cm.

29. The method of claim 22 wherein conductivity of the fluid composition is less than about 20 μS/cm.

30. The method of claim 22 wherein each emitter comprises a nozzle and the corresponding emitter orifice comprises a nozzle orifice of the corresponding nozzle.

31. The method of claim 22 wherein each emitter comprises an electrically insulating capillary tube, the corresponding emitter orifice comprises a first open end of the corresponding capillary tube, and a second open end of each capillary tube extends into a fluid reservoir.

32. The method of claim 22 wherein the emitters comprise pores in a porous, electrically insulating material.

33. The method of claim 22 wherein the fluid composition exits a plurality of the emitters that are arranged with a emitter spacing that is less than about 2 cm.

34. The method of claim 22 wherein applying the voltage to the fluid composition comprises applying the voltage to a conductive electrode immersed in the fluid composition within the emitters or within a fluid reservoir in communication with the emitters.

35. The method of claim 22 wherein applying the voltage to the fluid composition comprises applying the voltage to a conductive electrode positioned outside and adjacent to the emitters at a position upstream from the corresponding emitter orifices, without providing an electrical conduction pathway between the conductive electrode and the fluid composition.

36. The method of claim 22 wherein the applied voltage has a magnitude greater than about 10 kV.

37. The method of claim 22 wherein the applied voltage has a magnitude greater than about 15 kV.

38. The method of claim 22 wherein solvent is ejected from each fluid jet in a direction substantially transverse to the jet.

39. The method of claim 22 wherein the fluid jets emerge from a fluid meniscus at the emitter orifice.

40. The method of claim 22 wherein at least one of the discrete fluid jets forms without a corresponding Taylor cone that is visible outside the emitter orifice.

41. The method of claim 22 wherein the collected polymer particles are substantially devoid of the liquid solvent.

42. The method of claim 22 wherein the liquid solvent has a vapor pressure less than about 10 mm Hg at about 20° C., or has a boiling point greater than about 150° C. at one atmosphere.

43. The method of claim 22 wherein the fluid composition has a viscosity less than about 1000 centipoise.

44. The method of claim 22 wherein the fluid composition exits the emitters at a rate greater than about 100 μL/min/emitter.

45. The method of claim 22 wherein the polymer comprises polystyrene.

46. The method of claim 22 wherein the fibers are collected at a rate greater than about 0.5 g/hr/emitter.

47. The method of claim 22 wherein the fibers have an average diameter less than about 1 μm.

48. The method of claim 22 wherein the fibers have an average diameter less than about 500 nm.

49. The method of claim 22 wherein the collected polymer fibers form a portion of a filtration medium that transmits only particles smaller than about 1 μm.

50. The method of claim 22 wherein the emitter orifice and the collection surface are less than about 5 cm apart.

51. The method of claim 22 wherein the emitter orifice and the collection surface are less than about 1 cm apart.

52. The method of claim 22 wherein the collection surface is positioned between the emitter orifices and an electrically grounded surface.

53. The method of claim 52 wherein the applied voltage divided by a distance between the emitter orifices and the electrically grounded surface is greater than about 5 kV/cm.

54. The method of claim 52 wherein the electrically grounded surface is grounded by a direct connection to a ground connection of a voltage supply that supplies the applied voltage.

55. The method of claim 52 wherein the electrically grounded surface is grounded without any direct connection to a ground connection of a voltage supply that supplies the applied voltage.

56. The method of claim 55 wherein the emitter orifice and the collection surface are more than about 30 cm apart.

57. The method of claim 22 wherein the applied voltage divided by a distance between the emitter orifices and the collection surface is greater than about 5 kV/cm.

58. The method of claim 22 wherein the collection surface is electrically insulating.

59. The method of claim 22 wherein the collection surface is electrically isolated.

60. The method of claim 22 wherein the applied voltage is greater than about 10 kV, and the emitter orifice and the collection surface are more than about 30 cm apart.

61. The method of claim 60 wherein the applied voltage is greater than about 15 kV.

62. The method of claim 60 wherein the emitter orifice and the collection surface are more than about 50 cm apart.

63. The method of claim 22 wherein the collection surface comprises living tissue.

64. The method of claim 22 further comprising applying gas flow to propel the polymer particles to the collection surface.

65. The method of claim 22 further comprising applying gas flow to collect the ejected solvent.

66. The method of claim 22 further comprising applying ionized gas flow to stabilize a jet formed by the fluid that exits the emitter, or to suppress corona discharge from the emitter or fluid.

67. The method of claim 22 wherein the liquid solvent comprises a terpene, terpenoid, or aromatic solvent.

68. The method of claim 67 wherein the liquid solvent comprises d-limonene, p-cymene, or terpinene.

69. The method of claim 22 wherein the first material comprises DMF or NMP.

70. The method of claim 69 wherein the liquid solvent comprises a terpene, terpenoid, or aromatic solvent.

71. The method of claim 22 wherein the first material comprises a salt, a surfactant, or an ionic liquid, and the composition further comprises one or more of DMF, NMP, or MEK.

72. The method of claim 71 wherein the liquid solvent comprises a terpene, terpenoid, or aromatic solvent.

73. The method of claim 22 wherein the first material comprises solid particles suspended in the liquid solvent.

74. The method of claim 73 wherein the liquid solvent comprises a terpene, terpenoid, or aromatic solvent.

75. The method of claim 73 wherein the first material comprises titanium dioxide.

76. The method of claim 73 wherein the composition further comprises one or more of DMF, NMP, or MEK.

77. The method of claim 22 wherein the fluid composition further comprises a second material dissolved in the liquid solvent, which second material has a dielectric constant between that of the first material and that of the liquid solvent.

78. The method of claim 77 wherein the liquid solvent comprises a terpene, terpenoid, or aromatic solvent.

79. The method of claim 77 wherein the first material comprises a salt, a surfactant, or an ionic liquid, and the second material comprises one or more of DMF, NMP, or MEK.

* * * * *